US008236741B2

(12) United States Patent
Poirier et al.

(10) Patent No.: US 8,236,741 B2
(45) Date of Patent: Aug. 7, 2012

(54) METHOD FOR HAZE MITIGATION AND FILTERABILITY IMPROVEMENT FOR GAS-TO-LIQUID HYDROISOMERIZED BASE STOCKS

(75) Inventors: Marc-André Poirier, Sarnia (CA); Charles Lambert Baker, Jr., Thornton, PA (US); Nicholas Anthony Hilder, Oakton, VA (US); Chung-Lai Wong, Philadelphia, PA (US); Dorothy Wong, legal representative, Philadelphia, PA (US); James William Gleeson, Burke, VA (US); Vera Minak-Bernero, Bridgewater, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 737 days.

(21) Appl. No.: 12/291,901

(22) Filed: Nov. 14, 2008

(65) Prior Publication Data

US 2009/0186786 A1 Jul. 23, 2009

Related U.S. Application Data

(60) Provisional application No. 61/003,446, filed on Nov. 16, 2007.

(51) Int. Cl.

| | |
|---|---|
| ***C10M 169/04*** | (2006.01) |
| ***C10M 107/34*** | (2006.01) |
| ***C07C 69/34*** | (2006.01) |
| ***C08F 8/14*** | (2006.01) |

(52) U.S. Cl. ..... 508/287; 508/306; 508/465; 508/468; 508/579

(58) Field of Classification Search ..... 508/287, 508/465, 306, 468, 579, 469

See application file for complete search history.

(56) References Cited

U.S. PATENT DOCUMENTS

| | | | | |
|---|---|---|---|---|
| 4,069,162 | A | 1/1978 | Gardiner et al. | |
| 4,866,139 | A | 9/1989 | Gutierrez et al. | |
| 4,908,146 | A | 3/1990 | Smith, Jr. | |
| 5,716,915 | A * | 2/1998 | Brown et al. | 508/467 |
| 6,080,301 | A | 6/2000 | Berlowitz et al. | |
| 6,174,843 | B1 | 1/2001 | Peyton et al. | |
| 6,180,575 | B1 | 1/2001 | Nipe | |
| 6,468,417 | B1 | 10/2002 | Biscardi et al. | |
| 6,468,418 | B1 | 10/2002 | Biscardi et al. | |
| 6,495,495 | B1 | 12/2002 | Alger et al. | |
| 6,579,441 | B1 | 6/2003 | Biscardi et al. | |
| 6,699,385 | B2 | 3/2004 | Miller | |
| 6,712,991 | B2 | 3/2004 | Gore et al. | |
| 6,846,778 | B2 | 1/2005 | Johnson et al. | |
| 6,962,651 | B2 | 11/2005 | Miller et al. | |
| 2003/0207775 | A1 | 11/2003 | Sullivan et al. | |
| 2005/0059563 | A1 | 3/2005 | Sullivan et al. | |
| 2005/0261147 | A1 | 11/2005 | Rosenbaum et al. | |
| 2006/0003902 | A1 * | 1/2006 | Colbourne | 508/297 |
| 2006/0019841 | A1 | 1/2006 | Clague | |
| 2007/0142247 | A1 * | 6/2007 | Baillargeon et al. | 508/279 |

FOREIGN PATENT DOCUMENTS

| | | |
|---|---|---|
| GB | 763008 | 12/1956 |
| GB | 1086015 | 10/1967 |
| GB | 1197813 | 7/1970 |
| GB | 1198161 | 7/1970 |
| WO | WO 2004/033607 | 4/2004 |
| WO | WO 2005/063940 | 7/2005 |
| WO | WO 2005/063941 | 7/2005 |

* cited by examiner

*Primary Examiner* — Walter D Griffin
*Assistant Examiner* — Vishal Vasisth
(74) *Attorney, Agent, or Firm* — Robert A. Migliorini

(57) ABSTRACT

Haze formation in heavy Gas-to-Liquids (GTL) base stock is mitigated by the addition to said GTL base stock of one or more particular additives.

14 Claims, No Drawings

METHOD FOR HAZE MITIGATION AND FILTERABILITY IMPROVEMENT FOR GAS-TO-LIQUID HYDROISOMERIZED BASE STOCKS

CROSS-REFERENCE TO RELATED APPLICATIONS

This is a Non-Provisional Application that claims priority to U.S. Provisional Application 61/003,446 filed Nov. 16, 2007, which is herein incorporated by reference.

This application is a 371 of PCT/EP2005/057162, filed Dec. 23, 2005.

The present invention relates to Gas-to-Liquids (GTL) base stocks and to GTL base stocks of reduced/mitigated haze formation.

RELATED ART

Feed stocks for lubricating oil base stocks are generally mixtures of various carbon number hydrocarbons including by way of example and not limitation various carbon chain length paraffins, iso-paraffins, naphthenes, aromatics, etc. The presence of long carbon chain length paraffins in the hydrocarbon base stock cause pour point and cloud point to be relatively high, that is, the onset of solid wax formation in the oil occurs at relatively high temperature.

For lubricating oils to effectively function in their intended environments (internal combustion engines, turbines, hydraulic lines, etc.) they must remain liquid at low temperatures.

To this end hydrocarbon feed stocks used for lubricating oil base stock production are subjected to wax removal processes including solvent dewaxing wherein the wax is physically removed from the oil as a solid at low temperature using a solvent, or catalytic dewaxing whereby the use of a catalyst converts long chain normal or slightly branched long chain hydrocarbon (wax) by cracking/fragmentation into shorter chain hydrocarbon, to thereby reduce pour point and cloud point (both of which are measured at low temperature).

Waxy hydrocarbon feeds, including those synthesized from gaseous components such as CO and $H_2$, especially Fischer-Tropsch waxes are also suitable for conversion/treatment into lubricating base oils by subjecting such waxy feeds to hydrodewaxing or hydroisomerization/cat (and/or solvent) dewaxing whereby the long chain normal-paraffins and slightly branched paraffins are rearranged/isomerized into more heavily branched iso-paraffins of increased viscosity index and reduced pour and cloud point. Lubricating oils produced by the conversion/treatment of waxes or waxy stocks produced from gaseous components are known as Gas-to-Liquids (GTL) base oils/base stocks.

Despite being of reduced low temperature pour point and cloud point, however, heavy GTL base stocks exhibit low level haze formation which appears at temperatures usually higher than those traditionally used to measure pour point or cloud point. The onset of haze is seen on standing at ambient temperatures, e.g., room temperature, about 15 to 30° C., more usually 20 to 25° C.

The haze precursors are wax types which are more difficult to remove than are the waxes typically associated with pour point and cloud point and do not necessarily respond to conventional wax removal techniques such as solvent or catalytic dewaxing. As previously indicated, haze can form in oils merely upon standing at room temperature even after the oil has been dewaxed to a low pour point such as −5° C. or even lower. Haze disappears on heating but can reappear on standing and even at room temperature. The waxes associated with haze are predominantly paraffinic in nature and include iso-paraffins and n-paraffins which are of higher molecular weight than are the waxes usually associated Group I and Group II base stocks.

Haze formation reduces the desirability of the oil for lubricating oil formulations from a visual perspective of quality.

From a customer perspective, the appearance of haze has negative implications with regard to quality, customers usually associating high quality with oils exhibiting a clear and bright appearance on visual observation. The clear and bright standard is in accordance with ASTM D-4176-93 (Reapproved 1997). Haze can also be quantified under a turbidity test criterion expressed as nephelometric turbidity units (NTU) on a scale having a maximum value of 24. NTU is measured by a turbidimeter such as a Hach Model 18900 ratio turbidimeter, a Hach Model 2100 P turbidimeter, etc.

Haze is also seen as posing a potential for problems during use insofar as the wax associated with the haze could clog the pores of the fine filters needed for example for industrial circulating oils.

To address haze formation in hydroisomerized synthetic wax heavy lube oil having a kinematic viscosity @100° C. of about 10 $mm^2/s$ or greater mitigation steps such as higher reactor severity to create more isomerized product help lower the extent or intensity of haze but are generally, by themselves, insufficient, and also result in a reduced yield of the desired product. Restricting the distillation range to lower boiling molecular weights is sufficient but much of the 1000° F.+ range lube base stock will be sacrificed in this case.

Haze has been addressed in the recent art.

U.S. Pat. No. 6,579,441 reduces haze in lubricating oil base oil feeds by contacting the oil with a solid adsorbent to remove at least a portion of the haze precursors. The solid adsorbents reduce the cloud point and haze of the oil with minimal effect on yield. Sorbents used in the process are generally solid particulate matter having high adsorptive capacity and with a surface having some acidic character. Acid character is determined by measurement of acid site density, determined using, e.g., infra-red spectroscopic measurement of adsorbed basic molecules such as ammonia, n-butyl amine or pyridine. Sorbent materials include crystalline molecular sieves, alumino-silicate zeolites, activated carbon, aluminas, silica-alumina, and clays (e.g., bauxite, Fullers Earth, attapulgite, montmorillonite, halloysite, sepiolite) in various forms, e.g., powder, particles, extrudates, etc.

The oil to be treated is contacted with the adsorbent in batch mode or under continuous conditions using a fixed bed, moving bed, slurry bed, simulated moving bed, magnetically stabilized fluidized bed employing upflow, downflow or radical flow oil circulation, at temperatures usually below 66° C. and more preferably between about 10° C. and 50° C.

See also U.S. Pat. Nos. 6,468,417 and 6,468,418.

WO 2004/033607 teaches heavy hydrocarbon compositions useful as heavy lubricant base stocks. The heavy hydrocarbon composition comprise at least 95 wt % paraffin molecules of which at least 90 wt % are iso-paraffins, having a KV by ASTM D-445 of above 8 $mm^2/s$ at 100° C., an initial boiling point of at least 454° C. and an end boiling point of at least 538° C. This heavy hydrocarbon composition of this published application is a particular GTL heavy oil made from Fischer-Tropsch wax subjected to hydroisomerization. This heavy stock will typically be mildly hydrofinished and/or dehazed after hydrodewaxing to improve color, appearance and stability. It is stated that dehazing is typically achieved by either catalytic or absorptive methods to remove those constituents that result in haziness.

U.S. Pat. No. 6,699,385 teaches a process for producing a low haze heavy base oil including the steps of providing a heavy waxy feed stream having an initial boiling point greater than 900° F. and having a paraffin content of at least 80%, separating the heavy feed stream into a heavy fraction and a light fraction by deep cut distillation, and hydroisomerizing the light fraction to produce a low haze heavy base oil. In this patent "low haze" means a cloud point of 10° C. or less, preferably 5° C. or less, more preferably 0° C. or less.

WO 2005/063940 teaches a process for preparing a haze free base oil having a cloud point of below 0° C. and a kinematic viscosity at 100° C. of greater than 10 $mm^2/s$ by hydroisomerization of a Fischer-Tropsch synthesis product, isolation of one or more fuel products and a distillation residue, reduction of the wax content of the residue by contacting the residue with a hydroisomerization catalyst under hydroisomerization conditions and solvent dewaxing the hydroisomerized residue to obtain a haze free base oil. See also WO 2005/063941.

U.S. Pat. No. 6,962,651 teaches a method for producing a lubricant base oil comprising the steps of hydroisomerizing a feedstock over a medium pore size molecular sieve catalyst under hydroisomerization conditions to produce an isomerized product have a pour point of greater than a target pour point of the lubricant base oils, separating the isomerized product into at least a light lubricant base oil having a pour point less than or equal to the target pour point of the lubricant base oil and into a heavy fraction having a pour point of equal to or greater than the target pour point of the lubricant base oils and a cloud point greater than the target cloud point of the lubricant base oils and, dehazing the heavy fraction to proved a heavy lubricant base oil having a pour point less than or equal to the target pour point of the lubricant base oils and a cloud point less than or equal to the target cloud point of the lubricant base oils. The feedstock can be Fischer-Tropsch wax. Dehazing is described as a relatively mild process and can include solvent dewaxing, sorbent treatment such as clay treating, extraction, catalytic dehazing and the like.

U.S. Pat. No. 6,080,301 teaches a premium synthetic lubricating oil base stock having a high VI and a low pour point made by hydroisomerizing a Fischer-Tropsch synthesized waxy paraffinic feed wax and then dewaxing the hydroisomerate to form a 650-750° F.+ dewaxate. Fully formulated lube oils can be made from appropriate viscosity fractions of such base stock by addition of suitable additives which include one or more of a detergent, a dispersant, an antioxidant, an antiwear additive, a pour point depressant, a VI improver, a friction modifier, a demulsifier, an anti-foamant, a corrosion inhibitor and a seal swell control additive.

US Published Application 2005/0261147 teaches lubricant blends with low Brookfield viscosities, the base oil being a mixture of a base oil derived from highly paraffinic wax and a petroleum derived base oil and containing a pour point depressant. Representative of base oils derived from highly paraffinic wax are base oils derived from Fischer-Tropsch wax via hydroisomerization. Pour point depressants are described as materials known in the art and include, but are not limited to esters of maleic anhydride-styrene copolymers, polymethacrylates, polyacrylates, polyacrylamides, condensation products of haloparaffin waxes and aromatic compounds, vinyl carboxylate polymers, terpolymers of dialkyl fumarates, vinyl esters of fatty acids, ethylene-vinyl acetate copolymers, alkyl phenol formaldehyde condensation resins, alkyl vinyl ethers, olefin copolymers and mixtures thereof. The preferred pour point depressant is identified as polymethacrylate.

U.S. Pat. No. 6,495,495 teaches an additive comprising a blend of an alkyl ester copolymer, preferably an ethylene-vinyl acetate copolymer, and a naphthenic oil to improve flow properties of a mineral oil and to prevent filter blockage of a filter due to wax formation.

US 2006/0019841 teaches the use of a $C_{12}$-$C_{20}$ polyalkyl methacrylate polymer as a lubricating oil additive for mineral oil to improve the filterability of the lube oil as compared to the mineral oil base oil.

US 2003/0207775 teaches lubricating fluids of enhanced energy efficiency and durability comprising a high viscosity fluid blended with a lower viscosity fluid wherein the final blend has a viscosity index greater than or equal to 175. Preferably the high viscosity fluid comprises a polyalphaolefin and the lower viscosity fluid comprises a synthetic hydrocarbon or PAO and may further comprise the addition of one or more of an ester, mineral oil and/or hydro-processed mineral oil. Additives can also be present and include one or more of dispersants, detergents, friction modifiers, traction improving additives, demulsifiers, defoamants, chromophores (dyes) and/or haze inhibitors.

The high viscosity fluid has a kinematic viscosity greater than or equal to 40 $mm^2/s$ @100° C. and less than or equal to 3,000 $mm^2/s$ @100° C. while the lower viscosity fluid has a kinematic viscosity of less than or equal to 40 $mm^2/s$ at 100° C. and greater than or equal to 1.5 $mm^2/s$ at 100° C. Haze inhibitors are not identified or described in any way.

It would be a significant technical advance if the haze issue associated with heavy GTL lube base stocks could be solved by a technique other than subjecting the base stock to an additional or more severe final processing step, such as more severe solvent or catalytic dewaxing or adsorption, or more severe hydroisomerization all of which are marked by a reduction in yield.

DESCRIPTION OF THE INVENTION

It has been discovered that the haze in Gas-to-Liquids (GTL) base stock(s) and/or base oil(s) having a KV @100° C. of about 8 $mm^2/s$ or higher, preferably about 10 $mm^2/s$ or higher, more preferably about 12 $mm^2/s$ or higher observed in the oil on standing at ambient temperature, said haze being evidenced by a greater than 2.0 NTU at 20° C.±1° C. after about 13 days, can be reduced to a level evidencing an NTU value of about 2.0 NTU or less at 20° C.±1° C., preferably about 1.5 NTU or less at 20° C.±1° C., more preferably about 1.3 NTU or less at 20° C.±1° C. still more preferably about 1 NTU or less at 20° C.±1° C. for at least 13 days, preferably at least 30 days, more preferably at least 60 days, most preferably at least 90 days by the addition to the GTL base stock(s) and/or base oil(s) of a particular additive selected from the group consisting of:

I) polymer I

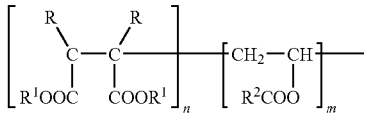

wherein Rs are the same or different and are independently selected from hydrogen, and methyl, preferably hydrogen, $R^1$s are the same or different and are independently selected from $C_1$ to $C_{24}$ alkyl and mixtures thereof, preferably $C_6$ to $C_{18}$ alkyl and mixtures thereof provided the average of the $R^1$ groups is in the range of $C_{10}$ to $C_{16}$, preferably $C_{10}$ to $C_{14}$, most preferably $C_{12}$ average, $R^2$ is selected from $C_1$ to $C_{18}$ alkyl and mixtures thereof, preferably $C_1$ alkyl, n and m are sufficient to provide the polymer of formula 1 a weight average Mw of from about 40,000 to about 80,000, preferably about 60,000; most preferably the polymer of formula I is R511® available from Infineum Corporation; or II polymer II, which is a mixture of (a)

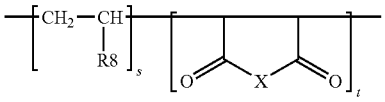

wherein $R^8$ is $C_{10}$-$C_{12}$ alkyl and mixtures thereof, x is oxygen or nitrogen and s+t together are sufficient to produce a co-polymer having a weight average molecular weight of about 800 to about 1000, and (b)

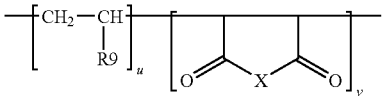

wherein $R^9$ is $C_{12}$ to $C_{14}$ alkyl and mixtures thereof, x is oxygen or nitrogen, and wherein at least some percentage of x is nitrogen in the range from about 0.01 to about 2 wt % of the neat polymer and u and v together are sufficient to produce a co-polymer having a weight average molecular weight of about 7000 to about 8,000 and (a) and (b) are in a ratio of about 60:40, preferably about 55:45; preferably polymer II is CP 8317® available from Laroute SA as a solution of about 40 to 60% polymer in heavy naphtha; or III a 4:1 to 1:4, preferably a 3:1 to 1:3, more preferably a 2:1 to 1:2, still more preferably a 1:1 mixture of the polymer of Formula I with a second polymer selected from the group consisting of:

A) $C_8$-$C_{12}$ alpha olefin fumarate ester copolymer (wt average molecular weight of from about 500 to about 20,000) preferably Ketjenlube 19® available from AKZO NOBEL Corporation B) poly(ethyl vinyl ether) [about 3,000 to about 5,000 weight average molecular wt]

C) 15-Crown-5 or (1,4,7,10,13-pentaoxacyclopentadecane 98%)

D)

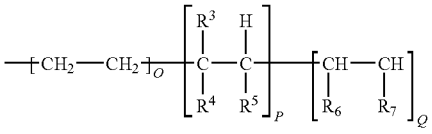

described in U.S. Pat. Nos. 4,211,534, 5,578,019 and 6,270,538 and wherein $R^3$ is selected from H or $CH_3$, $R^4$ is either or both —$OOCR^7$ or —$COOR^7$, $R^5$ is H or $COOR^7$, $R^6$ is —$CONHR^7$, or a 5 or 6 membered heterocyclic nitrogen containing ring which can contain one or more $C_1$ to $C_3$ alkyl groups, preferably pyridine, pyrrolidone, —$CONHR^7$, more preferably $CONHR^7$, $R^7$ is H, $C_1$ to $C_{18}$ alkyl group for D(a) or $C_1$ to $C_{18}$ alkyl phenol for D(b), O is zero to 100, preferably 10 to 100, P and Q are integers ranging from 10 to 100 wherein the total nitrogen content ranges from about 0.3 to 0.7 wt %, preferably about 0.57 wt % for D(a), preferably R446® available from Infineum Corporation, and from about 1.2 to 2.0 wt %, preferably about 1.75 wt % for D(b), preferably R434® available from Infineum Corporation. It is believed these materials are described in U.S. Pat. Nos. 5,578,091 and 6,270,538;

E)

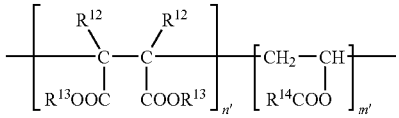

wherein $R^{12}$s are the same or different and are independently selected from H, $C_1$ to $C_8$ alkyl and mixtures thereof, preferably H, $R^{13}$s are the same or different and are independently selected from $C_1$ to $C_{24}$ alkyl and mixtures thereof, preferably $C_4$ to $C_{10}$ alkyl and mixtures thereof provided the average of the $R^{13}$ groups is in the range of $C_4$ to $C_8$, preferably $C_6$ average, $R^{14}$ is selected from $C_1$ to $C_{12}$ alkyl and mixtures thereof, preferably methyl and n'+m' being sufficient to provide a polymer having a weight average molecular weight of about 15,000 to about 80,000. Polymer E is preferably V387® available from Infineum Corporation.

F)

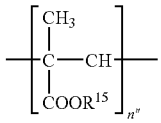

wherein n" is sufficient to provide a polymer having a weight average molecular weight of from about 20,000 to about 75,000, and $R^{15}$ is $C_6$ to $C_{30}$; preferably Lz 77169, Lz 7719®, and Lz 7949B® which are pour point depressants available from Lubrizol Corporation.

H) particular poly(methacrylate) esters available from Rohmax Corporation as:

(a) Viscoplex 1-330/333®

(b) Viscoplex 1-154®

(c) Viscoplex 0-220®

(d) dodecyl methacrylate of about 40,000 to about 80,000 weight average molecular weight, preferably Viscoplex 6-054®;

(J)

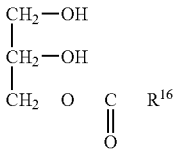

wherein $R^{16}$ is a $C_{10}$ to $C_{20}$ linear alkyl group, preferably $C_{17}$ linear alkyl group; preferably available from Uniqema Corporation as Perfad FM 3336®; or Polymer of Formula II;

IV) a 4:1 to 1:4, preferably 3:1 to 1:3, more preferably a 2:1 to 1:2, still more preferably a 1:1 mixture of the polymer of Formula II with a second polymer selected from the group consisting of:

A) $C_8$-$C_{12}$ alpha olefin fumarate ester copolymer (weight average molecular weight of from about 500 to about 20,000), preferably Ketjenlube 19® available from Akzo Nobel Corporation;

B) poly(ethyl vinyl ether) about 3,000 to about 5,000 weight AMW;

C) 15-Crown-5 or pentaoxacyclo pentadecane;

D(b)

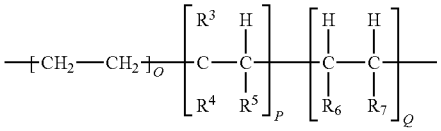

wherein $R^3$, $R^4$, $R^5$, $R^6$, O, P and Q are as previously defined, but $R^7$ is a $C_1$ to $C_{18}$ alkyl phenol and wherein the total nitrogen content ranges from about 1.2 to 2.0 wt %, preferably about 1.75 wt %, preferably R434® available from Infineum Corporation.

E)

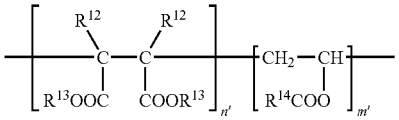

wherein $R^{12}$s are the same or different and are independently selected from H, $C_1$ to $C_8$ alkyl and mixtures thereof, preferably H, $R^{13}$s are the same or different and are independently selected from $C_1$ to $C_{24}$ alkyl and mixtures thereof, preferably $C_4$ to $C_{10}$ alkyl and mixtures thereof provided the average of the $R^{13}$ groups is in the range of $C_4$ to $C_8$, preferably $C_6$ average, $R^{14}$ is selected from $C_1$ to $C_{12}$ alkyl and mixtures thereof, preferably methyl, and n'+m' being sufficient to provide a polymer having a weight average molecular weight of about 15,000 to about 80,000. Polymer E is preferably V387 available from Infineum Corporation;

F)

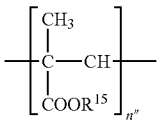

wherein n" is sufficient to provide a polymer having a weight average molecular weight of from about 20,000 to about 75,000, and $R^{15}$ is $C_6$ to $C_{30}$; preferably Lz 7716®, Lz 7719®, and Lz 7949B® available from Lubrizol Corporation;

H) Particular poly[methacrylate]esters available from Rohmax Corporation as (a) Viscoplex 1-330/333®

(b) Viscoplex 1-154®

(c) Viscoplex 0-220®

(d) a dodecyl methacrylate of about 40,000 to about 80,000 weight average molecular weight, preferably Viscoplex 6-054®;

polymer formula I; or

V) a 4:1 to 1:4, preferably a 3:1 to 1:3, more preferably a 2:1 to 1:2, still more preferably a 1:1 mixture of the polymer of Formula III which is a mixture of (a)

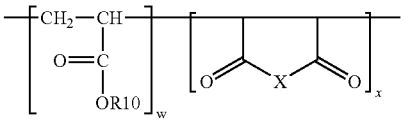

wherein $R^{10}$ is $C_{12}$ to $C_{14}$ alkyl and mixtures thereof and w+x together are sufficient to produce a co-polymer having a molecular weight of about 800 to 1000, and (b)

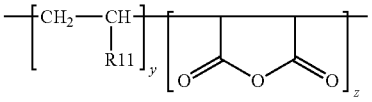

wherein $R^{11}$ is $C_{12}$ to $C_{14}$ alkyl and mixtures thereof and y+z together are sufficient to produce a co-polymer having a molecular weight of about 7,000 to 8,000, and (a) and (b) are in a ratio of about 60:40, preferably about 58:42; and mixtures thereof; preferably polymer III is Alpha 5482® available from Clearwater Engineered Chemistry as a solution of about 75% polymer in xylene, with a second polymer selected from the group consisting of:

H) particular poly[methacrylate]ester available from Rohmax Corporation as:

d) a dodecyl methacrylate of about 40,000 to 80,000 weight average molecular weight; preferably Viscoplex 6-054®; or VI) a 4:1 to 1:4, preferably a 3:1 to 1:3, more preferably a 2:1 to 1:2, still more preferably a 1:1 mixture of Polymer K (DODIFLOW 4313A) which is a cloud point depressant for middle distillate fuels and is represented by the following formula

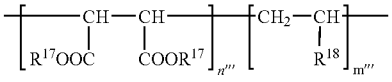

wherein $R^{17}$ is $C_{10}$ to $C_{16}$ alkyl and mixtures thereof and $R^{18}$ is $C_{10}$ to $C_{14}$ linear alkyl group and mixtures thereof and n'''+m''' ranges from 20 to 60 with a second polymer selected from the group consisting of:

D(b)

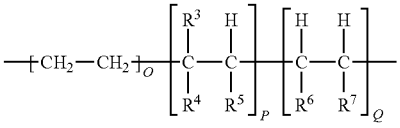

wherein $R^3$, $R^4$, $R^5$, $R^6$, O, P and Q are as previously defined, but $R^7$ is a $C_1$ to $C_{18}$ alkyl phenol and wherein the total nitrogen content ranges from about 1.2 to 2.0 wt %, preferably about 1.75 wt %, preferably R434® available from Infineum Corporation;

H) particular methacrylate ester from Rohmax Corporation:

(d) Viscoplex 6-054® [dodecyl methacrylate weight average molecular weight of from about 40,000 to 80,000]

Additives Identified above as Polymer I and Polymer E are believed to be described in U.S. Pat. Nos. 4,713,088; 5,011,505; 5,716,915; 5,939,365.

The amount of additive added to the GTL base stock(s) and/or base oil(s) typically is in the range of from about 50 to 5000 ppm, preferably 50 to 2,500 ppm, more preferably 100 to 2000 ppm, still more preferably 200 to 1000 ppm, most preferably about 250 to 1000 ppm based on active ingredient. When used individually the polymer of Formula I or II is employed in an amount in the range of about 250 to 1000 ppm while the preferred amount of Polymer III is about 250 ppm active ingredient. The GTL base stock and/or base oil can be treated per se with the recited additives or can be treated after mixing with one or more co-base stocks such as mineral oil and/or natural oil and/or synthetic oil the amount of additive added, in vppm, being based, however, on the quantity of the GTL base stock and/or base oil present in any such mixture of oils. Co base stocks would include oil derived from the hydrodewaxing or hydroisomerization/cat (and/or solvent) dewaxing of natural wax or waxy stocks such as slack wax, natural wax, waxy gas oil, waxy fuels hydrocracker bottoms, waxy raffinate, waxy hydrocrackate, thermal crackate or other mineral, mineral oil or even non petroleum oil derived waxy materials such as waxy materials derived from coal liquefaction or shale oil.

The present invention is also directed to a lubricating oil base stock having a reduced tendency to form haze after standing at ambient temperature, having a kinematic viscosity at 100° C. of about 8 $mm^2/s$ or higher, preferably about 10 $mm^2/s$ or higher, more preferably about 12 $mm^2/s$ or higher, a pour point of −15° C. or lower, a cloud point of +5° C. or lower, preferably 0° C. or lower, a NTU value at 20° C.±1° C. of 2 or lower, preferably about 1.5 or lower, more preferably about 1.3 or lower, still more preferably about 1.0 or lower after standing at ambient temperature for at least 13 days, preferably at least 30 days, more preferably at least 60 days, still more preferably at least 90 days, said base stock comprising a GTL heavy base stock having the afore recited kinematic viscosities @100° C. and from 50 to 5000 ppm of the above recited additive or additive mixture, more preferably 50 to 2500 ppm of the recited additive or mixture, more preferably 300 to 2000 ppm of the recited additive, still more preferably 200 to 1000 ppm, most preferably 250 to 1000 ppm based on active ingredient. When an additive of Formula I or II or III is used individually, it is ideally present in an amount of about 250 ppm.

Haze forming waxy molecules addressed in the present invention are those observed in heavy GTL base stock(s) and/or base oil(s), the haze being visible at temperatures above the traditionally measured cloud point of the oil. Typical cloud points are zero to −5° C.

The haze addressed in the present invention is that which appears at or near room temperature, the haze being indicative of the flocculation of the waxy molecules in the oil which can also interfere with the ability of the base stock(s) or base oil(s) to quickly filter through small openings such as the filters employed in equipment utilizing hydraulic fluids.

The haze of interest is usually not immediately apparent but appears over time while the oil stands at ambient temperature. It is speculated that the waxy molecules associated with this haze are present in very low concentrations, approximately 25 to 200 ppm whereas the concentration of waxy molecules associated with traditionally measured cloud point is believed to be about 1000 ppm or higher while the amount of waxy material associated with pour point of the oil is about 1 wt % (about 10,000 ppm).

Further, not only is the amount of waxy material associated with haze substantially lower than the amounts associated with cloud point and pour point but the nature of the waxy material itself is different.

Pour point and cloud point are traditionally associated with waxy material primarily consisting of n-paraffins or slightly branched iso-paraffins. The haze addressed in the present invention, however, is believed to be substantially branched iso-paraffins which not only differ structurally from the n-paraffins but are also substantially heavier than the n-paraffin, the iso-paraffins associated with haze having, it is believed, from 60 to 80 carbons whereas the n-paraffins/iso-paraffins associated with pour point and cloud point having 20 to 40 carbons.

Because of the difference in wax type and wax carbon number, it is believed one skilled in the art would not have expected the traditional pour point depressants and/or cloud point depressants to be effective to reduce ambient temperature haze. The cloud point depressants most useful in this invention are R511 from Infineum Corporation, and CP 8327 from Laroute S. A. which are known to work in diesel fuel having a boiling point in the range from about 320° F. to about 680° F. One skilled in the art would not have expected the diesel fuel cloud point depressant to work in heavy GTL base oil having a KV @100° C. of at least about 8 $mm^2/s$ and higher, i.e., oils having a boiling range of about 950° F. to about 1400° F.'

Thus, it has been discovered that only certain polymeric materials and mixtures of polymeric materials can be employed to effectively mitigate ambient temperature haze in heavy GTL base oil.

In the present invention the effective mitigation of ambient temperature haze is evidenced by the treated oil exhibiting a clear and bright appearance for at least 13 days, preferably 30 days or longer, more preferably 60 days or longer, still more preferably 90 days or longer, and a NTU value at 20° C.±1° C. of about 2 or lower, preferably about 1.0 or lower.

A measure of ambient temperature haze in the GTL base stock(s) and/or base oil(s) can be ascertained by use of a turbidity test using any typical turbidity meter known in the industry such as Hach Co. Model 2100P Turbidimeter or Hach Model 18900 ratio turbidimeter. A turbidity meter is a nephelometer that consists of a light source that illuminates the oil sample and a photoelectric cell that measures the intensity of light scattered at a 90° angle by the particles in the sample. A transmitted light detractor also receives light that passes through the sample. The signal output (units in nephilometric turbidity units or NTUs) of the turbidimeter is a ratio of the two detectors. Meters can measure turbidity over a wide range from 0 to 10,000 NTUs. The instrument must meet US-EPA design criteria as specified in US-EPA method 180.1. For the purposes of this specification and the claims the following correlation is employed:

| NTU value | Appearance |
|---|---|
| >20 | Cloudy |
| >2-10 | Visibly hazy |
| 0.2 to ≦2 | clear & bright |

The base stock(s) and/or base oil(s) for which ambient temperature haze is mitigated by the present method are Gas-to-Liquid (GTL) base stock(s) and/or base oil(s) which have cloud points (by ASTM D-5773) of about +5° C. or lower, preferably about 0° C. or lower, more preferably about −5° C. or lower, a kinematic viscosity (by ASTM D-445) at 100° C. of about 8 $mm^2/s$ or higher, preferably about 10 $mm^2/s$ or higher, more preferably about 12 $mm^2/s$ or higher and a typical boiling range having a 5% point ($T_5$) above 900° F. and a $T_{99}$ point of at least 1150° F., preferably >1250° F.

As stated, the present invention is directed to a method for mitigating the ambient temperature haze of Gas-to-Liquid (GTL) base stock(s) and/or base oil(s).

As used herein, the following terms have the indicated meanings:

a) "wax"—hydrocarbonaceous material having a high pour point, typically existing as a solid at room temperature, i.e., at a temperature in the range from about 15° C. to 25° C., and consisting predominantly of paraffinic materials;

b) "paraffinic" material: any saturated hydrocarbons, such as alkanes. Paraffinic materials may include linear alkanes, branched alkanes (iso-paraffins), cycloalkanes (cycloparaffins; mono-ring and/or multi-ring), and branched cycloalkanes;

c) "hydroprocessing": a refining process in which a feedstock is heated with hydrogen at high temperature and under pressure, commonly in the presence of a catalyst, to remove and/or convert less desirable components and to produce an improved product;

d) "hydrotreating": a catalytic hydrogenation process that converts sulfur- and/or nitrogen-containing hydrocarbons into hydrocarbon products with reduced sulfur and/or nitrogen content, and which generates hydrogen sulfide and/or ammonia (respectively) as byproducts; similarly, oxygen containing hydrocarbons can also be reduced to hydrocarbons and water;

e) "catalytic dewaxing": a conventional catalytic process in which normal paraffins (wax) and/or waxy hydrocarbons, e.g., slightly branched iso-paraffins, are converted by cracking/fragmentation into lower molecular weight species to insure that the final oil product (base stock or base oil) has the desired product pour point;

f) "solvent dewaxing": a process whereby wax is physically removed from oil by use of chilled solvent or an autorefrigerative solvent to solidify the wax which can then be removed from the oil;

g) "hydroisomerization" (or isomerization): a catalytic process in which normal paraffins (wax) and/or slightly branched iso-paraffins are converted by rearrangement/isomerization into branched or more branched iso-paraffins (the isomerate from such a process possibly requiring a subsequent additional wax removal step to ensure that the final oil product (base stock or base oil) has the desired product pour point);

h) "hydrocracking": a catalytic process in which hydrogenation accompanies the cracking/fragmentation of hydrocarbons, e.g., converting heavier hydrocarbons into lighter hydrocarbons, or converting aromatics and/or cycloparaffins (naphthenes) into non-cyclic branched paraffins.

i) "hydrodewaxing": (e.g., ISODEWAXING® of Chevron or MSDW™ of Exxon Mobil corporation) a very selective catalytic process which in a single step or by use of a single catalyst or catalyst mixture effects conversion of wax by isomerization/rearrangement of the n-paraffins and slightly branched isoparaffins into more heavily branched isoparaffins, the resulting product not requiring a separate conventional catalytic or solvent dewaxing step to meet the desired product pour point;

j) the terms "hydroisomerate", "isomerate", "catalytic dewaxate", and "hydrodewaxate" refer to the products produced by the respective processes, unless otherwise specifically indicated;

k) "base stock" is a single oil secured from a single feed stock source and subjected to a single processing scheme and meeting a particular specification;

l) "base oil" comprises one or more base stock(s).

Thus the term "hydroisomerization/cat dewaxing" is used to refer to catalytic processes which have the combined effect of converting normal paraffins and/or waxy hydrocarbons by rearrangement/isomerization, into more branched iso-paraffins, followed by (1) catalytic dewaxing to reduce the amount of any residual n-paraffins or slightly branched iso-paraffins present in the isomerate by cracking/fragmentation or by (2) hydrodewaxing to effect further isomerization and very selective catalytic dewaxing of the isomerate, to reduce the product pour point. When the term "(and/or solvent)", is included in the recitation, the process described involves hydroisomerization followed by solvent dewaxing (or a combination of solvent dewaxing and catalytic dewaxing) which effects the physical separation of wax from the hydroisomerate so as to reduce the product pour point.

GTL materials are materials that are derived via one or more synthesis, combination, transformation, rearrangement, and/or degradation/deconstructive processes from gaseous carbon-containing compounds, hydrogen-containing compounds, and/or elements as feedstocks such as hydrogen, carbon dioxide, carbon monoxide, water, methane, ethane, ethylene, acetylene, propane, propylene, propyne, butane, butylenes, and butynes. GTL base stocks and/or base oils are GTL materials of lubricating viscosity that are generally derived from hydrocarbons, for example waxy synthesized hydrocarbons, that are themselves derived from simpler gaseous carbon-containing compounds, hydrogen-containing compounds and/or elements as feedstocks. GTL base stock(s) and/or base oil(s) include oils boiling in the lube oil boiling range separated/fractionated from synthesized GTL materials such as for example, by distillation and subsequently subjected to a final wax processing step which is either or both of the well-known catalytic dewaxing process, or solvent dewaxing process, to produce lube oils of reduced/low pour point; synthesized wax isomerates, comprising, for example, hydrodewaxed, or hydroisomerized/cat (and/or solvent) dewaxed synthesized waxy hydrocarbons; hydrodewaxed, or hydroisomerized/cat (and/or solvent) dewaxed Fischer-Tropsch (F-T) material (i.e., hydrocarbons, waxy hydrocarbons, waxes and possible analogous oxygenates); preferably hydrodewaxed, or hydroisomerized/cat (and/or solvent) dewaxed F-T hydrocarbons, or hydrodewaxed or hydroisomerized/cat (or solvent) dewaxed, F-T waxes, hydrodewaxed, or hydroisomerized/cat (and/or solvent) dewaxed synthesized waxes, or mixtures thereof.

GTL base stock(s) and/or base oil(s) derived from GTL materials, especially, hydrodewaxed, or hydroisomerized/cat (and/or solvent) dewaxed F-T material derived base stock(s) and/or base oil(s), preferably hydrodewaxed, or hydroisomerized/cat (and/or solvent) dewaxed F-T wax derived base stock(s) and/or base oil(s) are characterized typically as having kinematic viscosities at 100° C. of from about 2 $mm^2/s$ to about 50 $mm^2/s$, preferably from about 3 $mm^2/s$ to about 50 $mm^2/s$, more preferably from about 3.5 $mm^2/s$ to about 30 $mm^2/s$, as exemplified by a GTL base stock derived by the hydrodewaxing or hydroisomerization/catalytic (or solvent dewaxing) of F-T wax, which has a kinematic viscosity of about 4 $mm^2/s$ at 100° C. and a viscosity index of about 130 or greater. Preferably the wax treatment process is hydrodewaxing carried out in a process using a single hydrodewaxing catalyst. Reference herein to Kinematic viscosity refers to a measurement made by ASTM method D445. In the present invention the GTL base stock(s) and/or base oil(s) which is/are the stock(s) which has/have the ambient temperature haze mitigated by use of particular polymeric additives are those GTL base stock(s) and/or base/oil(s) having a KV @100° C. of about 8 $mm^2/s$ or higher, preferably about 10 $mm^2/s$ or higher, more preferably about 12 $mm^2/s$ or higher.

GTL base stock(s) and/or base oil(s) derived from GTL materials, especially hydrodewaxed, or hydroisomerized/cat (and/or solvent) dewaxed F-T material derived base stock(s) and/or base oil(s), preferably hydrodewaxed, or hydroisomerized/cat (and/or solvent) dewaxed F-T wax-derived base stock(s) and/or base oil(s), which can be used as base stock and/or base oil components of this invention are further characterized typically as having pour points of about −5° C. or lower, preferably about −10° C. or lower, more preferably about −15° C. or lower, still more preferably about −20° C. or lower, and under some conditions may have advantageous pour points of about −25° C. or lower, with useful pour points of about −30° C. to about −40° C. or lower. If necessary, a separate dewaxing step may be practiced to achieve the desired pour point. References herein to pour point refer to measurement made by ASTM D97 and similar automated versions.

The GTL base stock(s) and/or base oil(s) derived from GTL materials, especially hydrodewaxed or hydroisomerized/cat (and/or solvent) dewaxed F-T material derived base stock(s) and/or base oil(s), preferably hydrodewaxed, or hydroisomerized/cat (and/or solvent) dewaxed F-T wax-derived base stock(s) and/or base oil(s) which can be used in this invention are also characterized typically as having viscosity indices of 80 or greater, preferably 100 or greater, and more preferably 120 or greater. Additionally, in certain particular instances, the viscosity index of these base stocks and/or base oil(s) may be preferably 130 or greater, more preferably 135 or greater, and even more preferably 140 or greater. For example, GTL base stock(s) and/or base oil(s) that derive from GTL materials preferably F-T materials especially F-T wax generally have a viscosity index of 130 or greater. References herein to viscosity index refer to ASTM method D2270.

In addition, the GTL base stock(s) and/or base oil(s) are typically highly paraffinic (>90% saturates), and may contain mixtures of monocycloparaffins and multicycloparaffins in combination with non-cyclic isoparaffins. The ratio of the naphthenic (i.e., cycloparaffin) content in such combinations varies with the catalyst and temperature used. Further, GTL base stock(s) and/or base oil(s) typically have very low sulfur and nitrogen content, generally containing less than about 10 ppm, and more typically less than about 5 ppm of each of these elements. The sulfur and nitrogen content of GTL base stock(s) and/or base oil(s) obtained by the hydroisomerization/isodewaxing of F-T material, especially F-T wax, is essentially nil.

In a preferred embodiment, the GTL base stock(s) and/or base oil(s) comprises paraffinic materials that consist predominantly of non-cyclic isoparaffins and only minor amounts of cycloparaffins. These GTL base stock(s) and/or base oil(s) typically comprise paraffinic materials that consist of greater than 60 wt % non-cyclic isoparaffins, preferably greater than 80 wt % non-cyclic isoparaffins, more preferably greater than 85 wt % non-cyclic isoparaffins, and most preferably greater than 90 wt % non-cyclic isoparaffins.

Useful compositions of GTL base stock(s) and/or base oil(s), hydrodewaxed or hydroisomerized/cat (and/or solvent) dewaxed F-T material derived base stock(s), such as wax isomerates or hydrodewaxates, are recited in U.S. Pat. Nos. 6,080,301; 6,090,989, and 6,165,949 for example.

The term GTL base stock and/or base oil as used herein and in the claims is to be understood as embracing individual fractions of GTL base stock and/or base oil as recovered in the production process, mixtures of two or more GTL base stock and/or base oil fractions, as well as mixtures of one, two or more low viscosity GTL base stock and/or base oil fraction(s) with one, two or more higher viscosity GTL base stock and/or base oil fraction(s) to produce a dumbbell blend wherein the blend exhibits a kinematic viscosity within the aforesaid recited range of at least about 8 $mm^2/s$ or higher.

In a preferred embodiment, the GTL material, from which the GTL base stock(s) and/or base oil(s) is/are derived is an F-T material (i.e., hydrocarbons, waxy hydrocarbons, wax). A slurry F-T synthesis process may be beneficially used for synthesizing the feed from CO and hydrogen and particularly one employing an F-T catalyst comprising a catalytic cobalt component to provide a high Schultz-Flory kinetic alpha for producing the more desirable higher molecular weight paraffins. This process is also well known to those skilled in the art.

In an F-T synthesis process, a synthesis gas comprising a mixture of $H_2$ and CO is catalytically converted into hydrocarbons and preferably liquid hydrocarbons. The mole ratio of the hydrogen to the carbon monoxide may broadly range from about 0.5 to 4, but is more typically within the range of from about 0.7 to 2.75 and preferably from about 0.7 to 2.5. As is well known, F-T synthesis processes include processes in which the catalyst is in the form of a fixed bed, a fluidized bed or as a slurry of catalyst particles in a hydrocarbon slurry liquid. The stoichiometric mole ratio for a F-T synthesis reaction is 2.0, but there are many reasons for using other than a stoichiometric ratio as those skilled in the art know. In cobalt slurry hydrocarbon synthesis process the feed mole ratio of the $H_2$ to CO is typically about 2.1/1. The synthesis gas comprising a mixture of $H_2$ and CO is bubbled up into the bottom of the slurry and reacts in the presence of the particulate F-T synthesis catalyst in the slurry liquid at conditions effective to form hydrocarbons, a portion of which are liquid at the reaction conditions and which comprise the hydrocarbon slurry liquid. The synthesized hydrocarbon liquid is separated from the catalyst particles as filtrate by means such as filtration, although other separation means such as centrifugation can be used. Some of the synthesized hydrocarbons pass out the top of the hydrocarbon synthesis reactor as vapor, along with unreacted synthesis gas and other gaseous reaction products. Some of these overhead hydrocarbon vapors are typically condensed to liquid and combined with the hydrocarbon liquid filtrate. Thus, the initial boiling point of the filtrate may vary depending on whether or not some of the condensed hydrocarbon vapors have been combined with it. Slurry hydrocarbon synthesis process conditions vary somewhat depending on the catalyst and desired products. Typical conditions effective to form hydrocarbons comprising mostly $C_{5+}$ paraffins, (e.g., $C_{5+}$-$C_{200}$) and preferably $C_{10+}$ paraffins, in a slurry hydrocarbon synthesis process employing a catalyst comprising a supported cobalt component include, for example, temperatures, pressures and hourly gas space velocities in the range of from about 320-850° F., 80-600 psi and 100-40,000 V/hr/V, expressed as standard volumes of the gaseous CO and $H_2$ mixture (0° C., 1 atm) per hour per volume of catalyst, respectively. The term "$C_{5+}$" is used herein to refer to hydrocarbons with a carbon number of greater than 4, but does not imply that material with carbon number 5 has to be present. Similarly other ranges quoted for carbon number do not imply that hydrocarbons having the limit values of the carbon number range have to be present, or that every carbon number in the quoted range is present. It is preferred that the hydrocarbon synthesis reaction be conducted under conditions in which limited or no water gas shift reaction occurs and more preferably with no water gas shift reaction occurring during the hydrocarbon synthesis. It is also preferred to conduct the reaction under conditions to achieve an alpha of at least 0.85, preferably at least 0.9 and more preferably at least 0.92, so as to synthesize more of the more desirable higher molecular weight hydrocarbons. This has been achieved in a slurry process using a catalyst containing a catalytic cobalt component. Those skilled in the art know that by alpha is meant the Schultz-Flory kinetic alpha. While suitable F-T reaction types of catalyst comprise, for example, one or more Group VIII catalytic metals such as Fe, Ni, Co, Ru and Re, it is preferred that the catalyst comprise a cobalt catalytic component. In one embodiment the catalyst comprises catalytically effective amounts of Co and one or more of Re, Ru, Fe, Ni, Th, Zr, Hf, U, Mg and La on a suitable inorganic support material, preferably one which comprises one or more refractory metal oxides. Preferred supports for Co containing catalysts comprise Titania, particularly. Useful catalysts and their preparation are known and illustrative, but nonlimiting examples may be found, for example, in U.S. Pat. Nos. 4,568,663; 4,663,305; 4,542,122; 4,621,072 and 5,545,674.

As set forth above, the waxy feed from which the base stock(s) and/or base oil(s) is/are derived is a wax or waxy GTL material, preferably F-T material, referred to as F-T wax. F-T wax preferably has an initial boiling point in the range of from 650-750° F. and preferably continuously boils up to an end point of at least 1050° F. A narrower cut waxy feed may also be used during the hydroisomerization. A portion of the n-paraffin waxy feed is converted to lower boiling isoparaffinic material. Hence, there must be sufficient heavy n-paraffin material to yield an isoparaffin containing isomerate boiling in the lube oil range. If catalytic dewaxing is also practiced after isomerization/isodewaxing, some of the isomerate/isodewaxate will also be hydrocracked to lower boiling material during the conventional catalytic dewaxing. Hence, it is preferred that the end boiling point of the waxy feed be above 1050° F. (1050° F.+).

When a boiling range is quoted herein it defines the lower and/or upper distillation temperature used to separate the fraction. Unless specifically stated (for example, by specifying that the fraction boils continuously or constitutes the entire range) the specification of a boiling range does not require that any material at the specified limit has to be present, rather it excludes material boiling outside that range.

The waxy feed preferably comprises the entire 650-750° F.+ fraction formed by the hydrocarbon synthesis process, having an initial cut point between 650° F. and 750° F. determined by the practitioner and an end point, preferably above 1050° F., determined by the catalyst and process variables employed by the practitioner for the synthesis. Such fractions are referred to herein as "650-750° F.+ fractions". By contrast, "650-750° F.$^-$ fractions" refers to a fraction with an unspecified initial cut point and an end point somewhere between 650° F. and 750° F. Waxy feeds may be processed as the entire fraction or as subsets of the entire fraction prepared by distillation or other separation techniques. The waxy feed also typically comprises more than 90%, generally more than 95% and preferably more than 98 wt % paraffinic hydrocarbons, most of which are normal paraffins. It has negligible amounts of sulfur and nitrogen compounds (e.g., less than 1 wppm of each), with less than 2,000 wppm, preferably less than 1,000 wppm and more preferably less than 500 wppm of oxygen, in the form of oxygenates. Waxy feeds having these properties and useful in the process of the invention have been made using a slurry F-T process with a catalyst having a catalytic cobalt component, as previously indicated.

The process of making the lubricant oil base stocks from waxy stocks, may be characterized as an isomerization process. If F-T waxes are used, preliminary hydrodenitrogenation and hydrodesulfurization treatment is not required because, as indicated above, such waxes have only trace amounts (less than about 10 ppm, or more typically less than about 5 ppm to nil) of sulfur or nitrogen compound content. However, some hydrodewaxing catalyst fed F-T waxes may benefit from prehydrotreatment for the removal of oxygenates while others may benefit from oxygenates treatment. The hydroisomerization or hydrodewaxing process may be conducted over a combination of catalysts, or over a single catalyst. Conversion temperatures range from about 150° C. to about 500° C. at pressures ranging from about 500 to 20,000 kPa. This process may be operated in the presence of hydrogen, and hydrogen partial pressures range from about 600 to 6000 kPa. The ratio of hydrogen to the hydrocarbon feedstock (hydrogen circulation rate) typically range from about 10 to 3500 n.l.l.$^{-1}$ (56 to 19,660 SCF/bbl) and the space velocity of the feedstock typically ranges from about 0.1 to 20 LHSV, preferably 0.1 to 10 LHSV.

Following any needed or desired hydrotreating step, the hydroprocessing used for the production of base stocks from such waxy feeds may use an amorphous hydrocracking/hydroisomerization catalyst, such as a lube hydrocracking (LHDC) catalysts, for example catalysts containing Co, Mo, Ni, W, Mo, etc., on oxide supports, e.g., alumina, silica, silica/alumina, or a crystalline hydrocracking/hydroisomerization catalyst, preferably a zeolitic catalyst.

Other isomerization catalysts and processes for hydrocracking, hydrodewaxing, or hydroisomerizing GTL materials and/or waxy materials to base stock or base oil are described, for example, in U.S. Pat. Nos. 2,817,693; 4,900,407; 4,937,399; 4,975,177; 4,921,594; 5,200,382; 5,516,740; 5,182,248; 5,290,426; 5,580,442; 5,976,351; 5,935,417; 5,885,438; 5,965,475; 6,190,532; 6,375,830; 6,332,974; 6,103,099; 6,025,305; 6,080,301; 6,096,940; 6,620,312; 6,676,827; 6,383,366; 6,475,960; 5,059,299; 5,977,425; 5,935,416; 4,923,588; 5,158,671; and 4,897,178; EP 0324528 (B1), EP 0532116 (B1), EP 0532118 (B1), EP 0537815 (B1), EP 0583836 (B2), EP 0666894 (B2), EP 0668342 (B1), EP 0776959 (A3), WO 97/031693 (A1), WO 02/064710 (A2), WO 02/064711 (A1), WO 02/070627 (A2), WO 02/070629 (A1), WO 03/033320 (A1) as well as in British Patents 1,429,494; 1,350,257; 1,440,230; 1,390,359; WO 99/45085 and WO 99/20720. Particularly favorable processes are described in European Patent Applications 464546 and 464547. Processes using F-T wax feeds are described in U.S. Pat. Nos. 4,594,172; 4,943,672; 6,046,940; 6,475,960; 6,103,099; 6,332,974; and 6,375,830.

Hydrocarbon conversion catalysts useful in the conversion of the n-paraffin waxy feedstocks disclosed herein to form the isoparaffinic hydrocarbon base oil are zeolite catalysts, such as ZSM-5, ZSM-11, ZSM-23, ZSM-35, ZSM-12, ZSM-38, ZSM-48, offretite, ferrierite, zeolite beta, zeolite theta, and zeolite alpha, as disclosed in U.S. Pat. No. 4,906,350. These catalysts are used in combination with Group VIII metals, in particular palladium or platinum. The Group VIII metals may be incorporated into the zeolite catalysts by conventional techniques, such as ion exchange.

In one embodiment, conversion of the waxy feedstock may be conducted over a combination of Pt/zeolite beta and Pt/ZSM-23 catalysts in the presence of hydrogen. In another embodiment, the process of producing the lubricant oil base stocks comprises hydroisomerization and dewaxing over a single catalyst, such as Pt/ZSM-35. In yet another embodiment, the waxy feed can be fed over a catalyst comprising Group VIII metal loaded ZSM-48, preferably Group VIII noble metal loaded ZSM-48, more preferably Pt/ZSM-48 in either one stage or two stages. In any case, useful hydrocarbon base oil products may be obtained. Catalyst ZSM-48 is described in U.S. Pat. No. 5,075,269. The use of the Group VIII metal loaded ZSM-48 family of catalysts, e.g., platinum on ZSM-48, in the hydroisomerization of the waxy feedstock eliminates the need for any subsequent, separate dewaxing step.

A dewaxing step, when needed, may be accomplished using one or more of solvent dewaxing, catalytic dewaxing or hydrodewaxing processes and either the entire hydroisomerate or the 650-750° F.+ fraction may be dewaxed, depending on the intended use of the 650-750° F.− material present, if it has not been separated from the higher boiling material prior to the dewaxing. In solvent dewaxing, the hydroisomerate may be contacted with chilled solvents such as acetone, methyl ethyl ketone (MEK), methyl isobutyl ketone (MIBK), mixtures of MEK/MIBK, or mixtures of MEK/toluene and the like, and further chilled to precipitate out the higher pour point material as a waxy solid which is then separated from the solvent-containing lube oil fraction which is the raffinate. The raffinate is typically further chilled in scraped surface chillers to remove more wax solids. Autorefrigerative dewaxing using low molecular weight hydrocarbons, such as propane, can also be used in which the hydroisomerate is mixed with, e.g., liquid propane, a least a portion of which is flashed off to chill down the hydroisomerate to precipitate out the wax. The wax is separated from the raffinate by filtration, membrane separation or centrifugation. The solvent is then stripped out of the raffinate, which is then fractionated to produce the preferred base stocks useful in the present invention. Also well known is catalytic dewaxing, in which the hydroisomerate is reacted with hydrogen in the presence of a suitable dewaxing catalyst at conditions effective to lower the pour point of the hydroisomerate. Catalytic dewaxing also converts a portion of the hydroisomerate to lower boiling materials, in the boiling range, for example, 650-750° F.−, which are separated from the heavier 650-750° F.+ base stock fraction and the base stock fraction fractionated into two or more base stocks. Separation of the lower boiling material may be accomplished either prior to or during fractionation of the 650-750° F.+ material into the desired base stocks.

Any dewaxing catalyst which will reduce the pour point of the hydroisomerate and preferably those which provide a large yield of lube oil base stock from the hydroisomerate may be used. These include shape selective molecular sieves which, when combined with at least one catalytic metal component, have been demonstrated as useful for dewaxing petroleum oil fractions and include, for example, ferrierite, mordenite, ZSM-5, ZSM-11, ZSM-23, ZSM-35, ZSM-48, ZSM-22 also known as theta one or TON, and the silicoaluminophosphates known as SAPO's. The dewaxing may be accomplished with the catalyst in a fixed, fluid or slurry bed. Typical dewaxing conditions include a temperature in the range of from about 400-600° F., a pressure of 500-900 psig, $H_2$ treat rate of 1500-3500 SCF/B for flow-through reactors and LHSV of 0.1-10, preferably 0.2-2.0. The dewaxing is typically conducted to convert no more than 40 wt % and preferably no more than 30 wt % of the hydroisomerate having an initial boiling point in the range of 650-750° F. to material boiling below its initial boiling point.

GTL base stock(s) and/or base oil(s), preferably hydrodewaxed, or hydroisomerized/cat (or solvent) dewaxed F-T wax-derived base stock(s) and/or base oil(s), have a beneficial kinematic viscosity advantage over conventional API Group II and Group III base stock(s) and/or base oil(s), and so may be very advantageously used with the instant invention. Such GTL base stock(s) and/or base oil(s) can have significantly higher kinematic viscosities, up to about 20-50 $mm^2/s$ at 100° C., whereas by comparison commercial Group II base oils can have kinematic viscosities up to about 15 $mm^2/s$ at 100° C., and commercial Group III base oils can have kinematic viscosities up to about 10 $mm^2/s$ at 100° C. The higher kinematic viscosity range of GTL base stock(s) and/or base oil(s), compared to the more limited kinematic viscosity range of Group II and Group III base stock(s) and/or base oil(s), in combination with the instant invention can provide additional beneficial advantages in formulating lubricant compositions.

In the present invention one or more hydrodewaxed, or hydroisomerized/cat (or solvent) dewaxed synthetic wax base stock(s) and/or base oil(s), preferably GTL base stock(s) and/or base oil(s), which has/have been dehazed by the process of the present invention, can constitute all or part of the base oil which forms the base oil for any formulated oil composition. One or more of these base stock(s) and/or base oil(s) derived from GTL materials can similarly be used as such following dehazing in accordance with the present invention or further in combination with other base stock(s) and/or base oil(s) of mineral oil origin, natural oils and/or with synthetic base oils.

The preferred base stock(s) and/or base oil(s) derived from GTL materials and/or from waxy feeds are characterized as having predominantly paraffinic compositions and are further characterized as having high saturates levels, low-to-nil sulfur, low-to-nil nitrogen, low-to-nil aromatics, and are essentially water-white in color.

A preferred GTL liquid hydrocarbon composition is one comprising paraffinic hydrocarbon components in which the extent of branching, as measured by the percentage of methyl hydrogens (BI), and the proximity of branching, as measured by the percentage of recurring methylene carbons which are four or more carbons removed from an end group or branch ($CH_2 \geqq 4$), are such that: (a) BI-0.5 ($CH_2 \geqq 4$)>15; and (b) BI+0.85 ($CH_2 \geqq 4$)<45 as measured over said liquid hydrocarbon composition as a whole.

The preferred GTL base stock and/or base oil can be further characterized, if necessary, as having less than 0.1 wt % aromatic hydrocarbons, less than 20 wppm nitrogen containing compounds, less than 20 wppm sulfur containing compounds, a pour point of less than −18° C., preferably less than −30° C., a preferred BI≧25.4 and ($CH_2 \geqq 4$)≦22.5. They have a nominal boiling point of 370° C.$^+$, on average they average fewer than 10 hexyl or longer branches per 100 carbon atoms and on average have more than 16 methyl branches per 100 carbon atoms. They also can be characterized by a combination of dynamic viscosity, as measured by CCS at −40° C., and kinematic viscosity, as measured at 100° C. represented by the formula: DV (at −40° C.)<2900 (KV at 100° C.)−7000.

The preferred GTL base stock and/or base oil is also characterized as comprising a mixture of branched paraffins characterized in that the lubricant base oil contains at least 90% of a mixture of branched paraffins, wherein said branched paraffins are paraffins having a carbon chain length of about $C_{20}$ to about $C_{40}$, a molecular weight of about 280 to about 562, a boiling range of about 650° F. to about 1050° F., and wherein said branched paraffins contain up to four alkyl branches and wherein the free carbon index of said branched paraffins is at least about 3.

In the above the Branching Index (BI), Branching Proximity ($CH_2 \geqq 4$), and Free Carbon Index (FCI) are determined as follows:

Branching Index

A 359.88 MHz 1H solution NMR spectrum is obtained on a Bruker 360 MHz AMX spectrometer using 10% solutions in $CDCl_3$. TMS is the internal chemical shift reference. $CDCl_3$ solvent gives a peak located at 7.28. All spectra are obtained under quantitative conditions using 90 degree pulse (10.9 μs), a pulse delay time of 30 s, which is at least five times the longest hydrogen spin-lattice relaxation time ($T_1$), and 120 scans to ensure good signal-to-noise ratios.

H atom types are defined according to the following regions:

9.2-6.2 ppm hydrogens on aromatic rings;

6.2-4.0 ppm hydrogens on olefinic carbon atoms;

4.0-2.1 ppm benzylic hydrogens at the α-position to aromatic rings;

2.1-1.4 ppm paraffinic CH methine hydrogens;

1.4-1.05 ppm paraffinic $CH_2$ methylene hydrogens;

1.05-0.5 ppm paraffinic $CH_3$ methyl hydrogens.

The branching index (BI) is calculated as the ratio in percent of non-benzylic methyl hydrogens in the range of 0.5 to 1.05 ppm, to the total non-benzylic aliphatic hydrogens in the range of 0.5 to 2.1 ppm.

Branching Proximity ($CH_2 \geqq 4$)

A 90.5 MHz$^3$CMR single pulse and 135 Distortionless Enhancement by Polarization Transfer (DEPT) NMR spectra are obtained on a Brucker 360 MHzAMX spectrometer using 10% solutions in $CDCL_3$. TMS is the internal chemical shift reference. $CDCL_3$ solvent gives a triplet located at 77.23 ppm in the $^{13}C$ spectrum. All single pulse spectra are obtained under quantitative conditions using 45 degree pulses (6.3 μs), a pulse delay time of 60 s, which is at least five times the longest carbon spin-lattice relaxation time ($T_1$), to ensure complete relaxation of the sample, 200 scans to ensure good signal-to-noise ratios, and WALTZ-16 proton decoupling.

The C atom types $CH_3$, $CH_2$, and CH are identified from the 135 DEPT $^{13}C$ NMR experiment. A major $CH_2$ resonance in all $^{13}C$ NMR spectra at ≈29.8 ppm is due to equivalent recurring methylene carbons which are four or more removed from an end group or branch (CH2>4). The types of branches are determined based primarily on the $^{13}C$ chemical shifts for the methyl carbon at the end of the branch or the methylene carbon one removed from the methyl on the branch.

Free Carbon Index (FCI). The FCI is expressed in units of carbons, and is a measure of the number of carbons in an isoparaffin that are located at least 5 carbons from a terminal carbon and 4 carbons way from a side chain. Counting the terminal methyl or branch carbon as "one" the carbons in the FCI are the fifth or greater carbons from either a straight chain terminal methyl or from a branch methane carbon. These carbons appear between 29.9 ppm and 29.6 ppm in the carbon-13 spectrum. They are measured as follows:

a) calculate the average carbon number of the molecules in the sample which is accomplished with sufficient accuracy for lubricating oil materials by simply dividing the molecular weight of the sample oil by 14 (the formula weight of $CH_2$);

b) divide the total carbon-13 integral area (chart divisions or area counts) by the average carbon number from step a. to obtain the integral area per carbon in the sample;

c) measure the area between 29.9 ppm and 29.6 ppm in the sample; and d) divide by the integral area per carbon from step b. to obtain FCI.

Branching measurements can be performed using any Fourier Transform NMR spectrometer. Preferably, the measurements are performed using a spectrometer having a magnet of 7.0 T or greater. In all cases, after verification by Mass Spectrometry, UV or an NMR survey that aromatic carbons were absent, the spectral width was limited to the saturated carbon region, about 0-80 ppm vs. TMS (tetramethylsilane). Solutions of 15-25 percent by weight in chloroform-dl were excited by 45 degrees pulses followed by a 0.8 sec acquisition time. In order to minimize non-uniform intensity data, the proton decoupler was gated off during a 10 sec delay prior to the excitation pulse and on during acquisition. Total experiment times ranged from 11-80 minutes. The DEPT and APT sequences were carried out according to literature descriptions with minor deviations described in the Varian or Bruker operating manuals.

DEPT is Distortionless Enhancement by Polarization Transfer. DEPT does not show quaternaries. The DEPT 45 sequence gives a signal for all carbons bonded to protons. DEPT 90 shows CH carbons only. DEPT 135 shows CH and $CH_3$ up and $CH_2$ 180 degrees out of phase (down). APT is Attached Proton Test. It allows all carbons to be seen, but if CH and $CH_3$ are up, then quaternaries and $CH_2$ are down. The sequences are useful in that every branch methyl should have a corresponding CH and the methyls are clearly identified by chemical shift and phase. The branching properties of each sample are determined by C-13 NMR using the assumption in the calculations that the entire sample is isoparaffinic. Corrections are not made for n-paraffins or cycloparaffins, which may be present in the oil samples in varying amounts. The cycloparaffins content is measured using Field Ionization Mass Spectroscopy (FIMS).

GTL base stock(s) and/or base oil(s), for example, hydrodewaxed or hydroisomerized/catalytic (and/or solvent) dewaxed waxy synthesized hydrocarbon, e.g., Fischer-Tropsch waxy hydrocarbon base stock(s) and/or base oil(s) are of low or zero sulfur and phosphorus content. There is a movement among original equipment manufacturers and oil formulators to produce formulated oils of ever increasingly reduced sulfated ash, phosphorus and sulfur content to meet ever increasingly restrictive environmental regulations. Such oils, known as low SAPS oils, would rely on the use of base oils which themselves, inherently, are of low or zero initial sulfur and phosphorus content. Such oils when used as base oils can be formulated with additives. Even if the additive or additives included in the formulation contain sulfur and/or phosphorus the resulting formulated lubricating oils will be lower or low SAPS oils as compared to lubricating oils formulated using conventional mineral oil base stock(s) and/or base oil(s).

For example, low SAPS formulated oils for vehicle engines (both spark ignited and compression ignited) will have a sulfur content of 0.7 wt % or less, preferably 0.6 wt % or less, more preferably 0.5 wt % or less, most preferably 0.4 wt % or less, an ash content of 1.2 wt % or less, preferably 0.8 wt % or less, more preferably 0.4 wt % or less, and a phosphorus content of 0.18% or less, preferably 0.1 wt % or less, more preferably 0.09 wt % or less, most preferably 0.08 wt % or less, and in certain instances, even preferably 0.05 wt % or less.

The lubricating oil comprising the dehazed GTL base stock(s) and/or base oil(s) can be used as is or more typically in combination with one or more second base oils and/or with one or more performance additives.

Examples of typical performance additives include, but are not limited to, oxidation inhibitors, antioxidants, dispersants, detergents, corrosion inhibitors, rust inhibitors, metal deactivators, anti-wear agents, extreme pressure additives, anti-seizure agents, pour point depressants, wax modifiers, other viscosity index improvers, other viscosity modifiers, fluid-loss additives, seal compatibility agents, friction modifiers, lubricity agents, anti-staining agents, chromophoric agents, defoamants, demulsifiers, emulsifiers, densifiers, wetting agents, gelling agents, tackiness agents, colorants, and others. For a review of many commonly used additives, see Klamann in "Lubricants and Related Products", Verlag Chemie, Deerfield Beach, Fla.; ISBN 0-89573-177-0. Reference is also made to "Lubricant Additives" by M. W. Ranney, published by Noyes Data Corporation of Parkridge, N.J. (1973).

Finished lubricants usually comprise the lubricant base stock or base oil, plus at least one performance additive.

The types and quantities of performance additives used in combination with the instant invention in lubricant compositions are not limited by the examples shown herein as illustrations.

Antiwear and EP Additives

Many lubricating oils require the presence of antiwear and/or extreme pressure (EP) additives in order to provide adequate antiwear protection. Increasingly specifications for lubricant performance, e.g., engine oil performance, have exhibited a trend for improved antiwear properties of the oil. Antiwear and extreme EP additives perform this role by reducing friction and wear of metal parts.

While there are many different types of antiwear additives, for several decades the principal antiwear additive for internal combustion engine crankcase oils is a metal alkylthiophosphate and more particularly a metal dialkyldithiophosphate in which the primary metal constituent is zinc, or zinc dialkyldithiophosphate (ZDDP). ZDDP compounds generally are of the formula $Zn[SP(S)(OR^1)(OR^2)]_2$ where $R^1$ and $R^2$ are $C_1$-$C_{18}$ alkyl groups, preferably $C_2$-$C_{12}$ alkyl groups. These alkyl groups may be straight chain or branched. The ZDDP is typically used in amounts of from about 0.4 to 1.4 wt % of the total lube oil composition, although more or less can often be used advantageously.

However, it is found that the phosphorus from these additives has a deleterious effect on the catalyst in catalytic converters and also on oxygen sensors in automobiles. One way to minimize this effect is to replace some or all of the ZDDP with phosphorus-free antiwear additives.

A variety of non-phosphorous additives are also used as antiwear additives. Sulfurized olefins are useful as antiwear and EP additives. Sulfur-containing olefins can be prepared by sulfurization of various organic materials including aliphatic, arylaliphatic or alicyclic olefinic hydrocarbons containing from about 3 to 30 carbon atoms, preferably 3-20 carbon atoms. The olefinic compounds contain at least one non-aromatic double bond. Such compounds are defined by the formula $$R^3R^4C{=}CR^5R^6$$

where each of $R^3$-$R^6$ are independently hydrogen or a hydrocarbon radical. Preferred hydrocarbon radicals are alkyl or alkenyl radicals. Any two of $R^3$-$R^6$ may be connected so as to form a cyclic ring. Additional information concerning sulfurized olefins and their preparation can be found in U.S. Pat. No. 4,941,984, incorporated by reference herein in its entirety.

The use of polysulfides of thiophosphorus acids and thiophosphorus acid esters as lubricant additives is disclosed in U.S. Pat. Nos. 2,443,264; 2,471,115; 2,526,497; and 2,591,577. Addition of phosphorothionyl disulfides as an antiwear, antioxidant, and EP additive is disclosed in U.S. Pat. No. 3,770,854. Use of alkylthiocarbamoyl compounds in combination with a molybdenum compound (oxymolybdenum diisopropyl-phosphorodithioate sulfide, for example) and a phosphorous ester (dibutyl hydrogen phosphite, for example) as antiwear additives in lubricants is disclosed in U.S. Pat. Nos. 4,501,678. 4,758,362 discloses use of a carbamate additive to provide improved antiwear and extreme pressure properties. The use of thiocarbamate as an antiwear additive is disclosed in U.S. Pat. No. 5,693,598. Thiocarbamate/molybdenum complexes such as moly-sulfur alkyl dithio-carbamate trimer complex ($R{=}C_8$-$C_{18}$ alkyl) are also useful antiwear agents. The use or addition of such materials should be kept to a minimum if the object is to produce low SAP formulations.

Esters of glycerol may be used as antiwear agents. For example, mono-, di-, and tri-oleates, mono-stearates, mono-palmitates and mono-myristates may be used.

ZDDP is combined with other compositions that provide antiwear properties. U.S. Pat. No. 5,034,141 discloses that a combination of a thiodixanthogen compound (octylthiodixanthogen, for example) and a metal thiophosphate (ZDDP, for example) can improve antiwear properties. U.S. Pat. No. 5,034,142 discloses that use of a metal alkyoxyalkylxanthate (nickel ethoxyethylxanthate, for example) and a dixanthogen (diethoxyethyl dixanthogen, for example) in combination with ZDDP improves antiwear properties.

Preferred antiwear additives include phosphorus and sulfur compounds such as zinc dithiophosphates and/or sulfur, nitrogen, boron, molybdenum phosphorodithioates, molybdenum dithiocarbamates and various organo-molybdenum derivatives including heterocyclics, for example dimercaptothia-diazoles, mercaptobenzothiadiazoles, triazines, and the like, alicyclics, amines, alcohols, esters, diols, triols, fatty amides and the like can also be used. Such additives may be used in an amount of about 0.01 to 6 wt %, preferably about 0.01 to 4 wt %. ZDDP-like compounds provide limited hydroperoxide decomposition capability, significantly below that exhibited by compounds disclosed and claimed in this patent and can therefore be eliminated from the formulation or, if retained, kept at a minimal concentration to facilitate production of low SAP formulations.

Viscosity Index Improvers

Viscosity index improvers (also known as VI improvers, viscosity modifiers, and viscosity improvers) provide lubricants with high and low temperature operability. These additives impart shear stability at elevated temperatures and acceptable viscosity at low temperatures.

Suitable viscosity index improvers include high molecular weight hydrocarbons, polyesters and viscosity index improver dispersants that function as both a viscosity index improver and a dispersant. Typical molecular weights of these polymers are between about 10,000 to 1,000,000, more typically about 20,000 to 500,000, and even more typically between about 50,000 and 200,000.

Examples of suitable viscosity index improvers are polymers and copolymers of methacrylate, butadiene, olefins, or alkylated styrenes. Poly-isobutylene is a commonly used viscosity index improver. Another suitable viscosity index improver is polymethacrylate (copolymers of various chain length alkyl methacrylates, for example), which also serve as pour point depressants in some formulations. Other suitable viscosity index improvers include copolymers of ethylene and propylene, hydrogenated block copolymers of styrene and isoprene, and polyacrylates (copolymers of various chain length acrylates, for example). Specific examples include styrene-isoprene or styrene-butadiene based polymers of 50,000 to 200,000 molecular weight.

Viscosity index improvers may be used in an amount of about 0.01 to 8 wt %, preferably about 0.01 to 4 wt %.

Antioxidants

Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in "Lubricants and Related Products", op cite, and U.S. Pat. Nos. 4,798,684 and 5,084,197, for example.

Useful antioxidants include hindered phenols. These phenolic anti-oxidants may be ashless (metal-free) phenolic compounds or neutral or basic metal salts of certain phenolic compounds. Typical phenolic antioxidant compounds are the hindered phenols which are the phenols which contain a sterically-hindered hydroxy group, and these include those derivatives of dihydroxy aryl compounds in which the hydroxy groups are in the ortho- or para-position relative to each other. Typical phenolic antioxidants include the hindered phenols substituted with $C_4$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptylphenol; 2,6-di-t-butyl-4-dodecylphenol; 2-methyl-6-t-butyl-4-heptylphenol; and 2-methyl-6-t-butyl-4-dodecylphenol. Other useful hindered mono-phenolic antioxidants may include, for example, the hindered 2,6-di-alkylphenolic proprionic ester derivatives. Bis-phenolic antioxidants may also be advantageously used in combination with the instant invention. Examples of ortho-coupled bisphenols include: 2,2'-bis(4-heptyl-6-t-butylphenol); 2,2'-bis(4-octyl-6-t-butylphenol); and 2,2'-bis(4-dodecyl-6-t-butylphenol). Para-coupled bisphenols include for example 4, 4'-bis(2,6-di-t-butylphenol) and 4,4'-methylene-bis(2,6-di-t-butylphenol).

Non-phenolic oxidation inhibitors which may be used include aromatic amine antioxidants and these may be used either as such or in combination with phenolic antioxidants. Typical examples of non-phenolic antioxidants include: alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to about 20 carbon atoms, and preferably contains from about 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of amine antioxidants useful in the present compositions include diphenylamines, phenyl naphthylamines, phenothiazines, iminodibenzyls and diphenyl phenylene diamines. Mixtures of two or more aromatic amines are also useful. Polymeric amine antioxidants can also be used. Particular examples of aromatic amine antioxidants useful in the present invention include: p,p'-dioctyldiphenylamine; t-octylphenyl-alpha-naphthylamine; phenyl-alpha-naphthylamine; and p-octylphenyl-alpha-naphthylamine.

Sulfurized alkylphenols and alkali or alkaline earth metal salts thereof also are useful antioxidants.

Another class of antioxidant used in lubricating oil compositions is oil-soluble copper compounds. Any oil-soluble suitable copper compound may be blended into the lubricating oil. Examples of suitable copper antioxidants include copper dihydrocarbyl thio- or dithio-phosphates and copper salts of naturally occurring or synthetic carboxylic acids. Other suitable copper salts include copper dithiacarbamates, sulphonates, phenates, and acetylacetonates. Basic, neutral, or acidic copper Cu(I) and or Cu(II) salts derived from alkenyl succinic acids or anhydrides are know to be particularly useful.

Preferred antioxidants include hindered phenols or arylamines. These antioxidants may be used individually by type or in combination with one another. Such additives may be used in an amount of about 0.01 to 5 wt %, preferably about 0.01 to 1.5 wt %.

Detergents

Detergents are commonly used in lubricating compositions. A typical detergent is an anionic material that contains a long chain hydrophobic portion of the molecule and a smaller oleophobic anionic or hydrophilic portion of the molecule. The anionic portion of the detergent is typically derived from an organic acid such as a sulfur acid, carboxylic acid, phosphorus acid, phenol, or mixtures thereof. The counterion is typically an alkaline earth or alkali metal.

Salts that contain a substantially stoichiometric amount of the metal are described as neutral salts and have a total base number (TBN, as measured by ASTM D2896) of from 0 to about 80. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased.

It is desirable for at least some detergent to be overbased. Overbased detergents help neutralize acidic impurities produced by the combustion process and become entrapped in the oil. Typically, the overbased material has a ratio of metallic ion to anionic portion of the detergent of about 1.05:1 to 50:1 on an equivalent basis. More preferably, the ratio is from about 4:1 to about 25:1. The resulting detergent is an overbased detergent that will typically have a TBN of about 150 or higher, often about 250 to 450 or more. Preferably, the overbasing cation is sodium, calcium, or magnesium. A mixture of detergents of differing TBN can be used in the present invention.

Preferred detergents include the alkali or alkaline earth metal salts of sulfonates, phenates, carboxylates, phosphates, and salicylates.

Sulfonates may be prepared from sulfonic acids that are typically obtained by sulfonation of alkyl-substituted aromatic hydrocarbons. Hydrocarbon examples include those obtained by alkylating benzene, toluene, xylene, naphthalene, biphenyl and their halogenated derivatives (chlorobenzene, chlorotoluene, and chloronaphthalene, for example). The alkylating agents typically have about 3 to 70 carbon atoms. The alkaryl sulfonates typically contain about 9 to about 80 or more carbon atoms, more typically from about 16 to 60 carbon atoms.

Klamann in "Lubricants and Related Products", op cit, discloses a number of overbased metal salts of various sulfonic acids which are useful as detergents and dispersants in lubricants. The book entitled "Lubricant Additives", C. V.

Smallheer and R. K. Smith, published by the Lezius-Hiles Co. of Cleveland, Ohio (1967), similarly discloses a number of overbased sulfonates that are useful as dispersants and/or detergents.

Alkaline earth phenates are another useful class of detergent for lubricants. These detergents can be made by reacting alkaline earth metal hydroxide or oxide (CaO, $Ca(OH)_2$, BaO, $Ba(OH)_2$, MgO, $Mg(OH)_2$, for example) with an alkylphenol or sulfurized alkylphenol. Useful alkyl groups include straight chain or branched $C_1$-$C_{30}$ alkyl groups, preferably, $C_4$-$C_{20}$. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched. When a non-sulfurized alkylphenol is used, the sulfurized product may be obtained by methods well known in the art. These methods include heating a mixture of alkylphenol and sulfurizing agent (including elemental sulfur or sulfur halides, such as sulfur dichloride, and the like) and then reacting the sulfurized phenol with an alkaline earth metal hydroxide or oxide.

Metal salts of carboxylic acids are also useful as detergents. These carboxylic acid detergents may be prepared by reacting a basic metal compound with at least one carboxylic acid and removing free water from the reaction product. These compounds may be overbased to produce the desired TBN level. Detergents made from salicylic acid are one preferred class of detergents derived from carboxylic acids. Useful salicylates include long chain alkyl salicylates. One useful family of compositions is of the formula

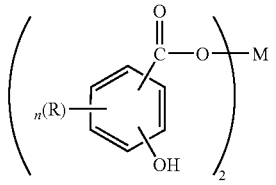

where R is a hydrogen atom or an alkyl group having 1 to about 30 carbon atoms, n is an integer from 1 to 4, and M is an alkaline earth metal. Preferred R groups are alkyl chains of at least $C_{11}$, preferably $C_{13}$ or greater. R may be optionally substituted with substituents that do not interfere with the detergent's function. M is preferably calcium, magnesium, or barium. More preferably, M is calcium.

Hydrocarbyl-substituted salicylic acids may be prepared from phenols by the Kolbe reaction. See U.S. Pat. No. 3,595,791, for additional information on synthesis of these compounds. The metal salts of the hydrocarbyl-substituted salicylic acids may be prepared by double decomposition of a metal salt in a polar solvent such as water or alcohol.

Alkaline earth metal phosphates are also used as detergents.

Detergents may be simple detergents or what is known as hybrid or complex detergents. The latter detergents can provide the properties of two detergents without the need to blend separate materials. See U.S. Pat. No. 6,034,039 for example.

Preferred detergents include calcium phenates, calcium sulfonates, calcium salicylates, magnesium phenates, magnesium sulfonates, magnesium salicylates and other related components (including borated detergents). Typically, the total detergent concentration is about 0.01 to about 6.0 wt %, preferably, about 0.1 to 0.4 wt %.

Dispersant

During engine operation, oil-insoluble oxidation byproducts are produced. Dispersants help keep these byproducts in solution, thus diminishing their deposition on metal surfaces. Dispersants may be ashless or ash-forming in nature. Preferably, the dispersant is ashless. So-called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

Chemically, many dispersants may be characterized as phenates, sulfonates, sulfurized phenates, salicylates, naphthenates, stearates, carbamates, thiocarbamates, phosphorus derivatives. A particularly useful class of dispersants are the alkenylsuccinic derivatives, typically produced by the reaction of a long chain substituted alkenyl succinic compound, usually a substituted succinic anhydride, with a polyhydroxy or polyamino compound. The long chain group constituting the oleophilic portion of the molecule which confers solubility in the oil, is normally a polyisobutylene group. Many examples of this type of dispersant are well known commercially and in the literature. Exemplary patents describing such dispersants are U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants may be found, for example, in European Patent Application No. 471 071, to which reference is made for this purpose.

Hydrocarbyl-substituted succinic acid compounds are popular dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between alkenyl succinic anhydrides and amines. Molar ratios can vary depending on the polyamine. For example, the molar ratio of alkenyl succinic anhydride to TEPA can vary from about 1:1 to about 5:1. Representative examples are shown in U.S. Pat. Nos. 3,087,936; 3,172,892; 3,219,666; 3,272,746; 3,322,670; and 3,652,616, 3,948,800; and Canada Patent No. 1,094,044.

Succinate esters are formed by the condensation reaction between alkenyl succinic anhydrides and alcohols or polyols. Molar ratios can vary depending on the alcohol or polyol used. For example, the condensation product of an alkenyl succinic anhydride and pentaerythritol is a useful dispersant.

Succinate ester amides are formed by condensation reaction between alkenyl succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305.

The molecular weight of the alkenyl succinic anhydrides used in the preceding paragraphs will typically range between 800 and 2,500. The above products can be post-reacted with various reagents such as sulfur, oxygen, formaldehyde, carboxylic acids such as oleic acid, and boron compounds such as borate esters or highly borated dispersants. The dispersants can be borated with from about 0.1 to about 5 moles of boron per mole of dispersant reaction product.

Mannich base dispersants are made from the reaction of alkylphenols, formaldehyde, and amines. See U.S. Pat. No. 4,767,551, which is incorporated herein by reference. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this invention can be prepared from high molecular weight alkyl-substituted hydroxyaromatics or $HN(R)_2$ group-containing reactants.

Examples of high molecular weight alkyl-substituted hydroxyaromatic compounds are polypropylphenol, polybutylphenol, and other polyalkylphenols. These polyalkylphenols can be obtained by the alkylation, in the presence of an alkylating catalyst, such as $BF_3$, of phenol with high molecular weight poly-propylene, polybutylene, and other polyalkylene compounds to give alkyl substituents on the benzene ring of phenol having an average 600-100,000 molecular weight.

Examples of $HN(R)_2$ group-containing reactants are alkylene polyamines, principally polyethylene polyamines. Other representative organic compounds containing at least one $HN(R)_2$ group suitable for use in the preparation of Mannich condensation products are well known and include the mono- and di-aminoalkanes and their substituted analogs, e.g., ethylamine and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

Examples of alkylene polyamide reactants include ethylenediamine, diethylene triamine, triethylene tetraamine, tetraethylene pentaamine, pentaethylene hexamine, hexaethylene heptaamine, heptaethylene octaamine, octaethylene nonaamine, nonaethylene decamine, and decaethylene undecamine mixture of such amines having nitrogen contents corresponding to the alkylene polyamines, in the formula $H_2N—(Z—NH—)_nH$, mentioned before, Z is a divalent ethylene and n is 1 to 10 of the foregoing formula. Corresponding propylene polyamines such as propylene diamine and di-, tri-, tetra-, pentapropylene tri-, tetra-, penta- and hexaamines are also suitable reactants. The alkylene polyamines are usually obtained by the reaction of ammonia and dihalo alkanes, such as dichloro alkanes. Thus the alkylene polyamines obtained from the reaction of 2 to 11 moles of ammonia with 1 to 10 moles of dichloroalkanes having 2 to 6 carbon atoms and the chlorines on different carbons are suitable alkylene polyamine reactants.

Aldehyde reactants useful in the preparation of the high molecular products useful in this invention include the aliphatic aldehydes such as formaldehyde (also known as paraformaldehyde and formalin to those moderately skilled in the art), acetaldehyde and aldol (β-hydroxybutyraldehyde). Formaldehyde or a formaldehyde-yielding reactant is preferred.

Hydrocarbyl substituted amine ashless dispersant additives are well known to one skilled in the art; see, for example, U.S. Pat. Nos. 3,275,554; 3,438,757; 3,565,804; 3,755,433, 3,822,209, and 5,084,197.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn from about 500 to about 5000 or a mixture of such hydrocarbylene groups. Other preferred dispersants include succinic acid-esters and amides, alkylphenol-polyamine-coupled Mannich adducts, their capped derivatives, and other related components. Such additives may be used in an amount of about 0.1 to 20 wt %, preferably about 0.1 to 8 wt %.

Pour Point Depressants

Conventional pour point depressants (also known as lube oil flow improvers) may be added to the compositions of the present invention if desired. These pour point depressants may be added to lubricating compositions of the present invention to lower the minimum temperature at which the fluid will flow or can be poured. Examples of suitable pour point depressants include alkylated naphthalene, polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655,479; 2,666,746; 2,721,877; 2,721,878; and 3,250,715 describe useful pour point depressants and/or the preparation thereof. Such additives may be used in an amount of about 0.01 to 5 wt %, preferably about 0.01 to 1.5 wt %.

Corrosion Inhibitors

Corrosion inhibitors are used to reduce the degradation of metallic parts that are in contact with the lubricating oil composition. Suitable corrosion inhibitors include thiadiazoles. See, for example, U.S. Pat. Nos. 2,719,125; 2,719,126; and 3,087,932, which are incorporated herein by reference in their entirety. Such additives may be used in an amount of about 0.01 to 5 wt %, preferably about 0.01 to 1.5 wt %.

Seal Compatibility Additives

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Such additives may be used in an amount of about 0.01 to 3 wt %, preferably about 0.01 to 2 wt %.

Anti-Foam Agents

Anti-foam agents may advantageously be added to lubricant compositions. These agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional minor amounts along with other additives such as demulsifiers; usually the amount of these additives combined is less than 1 percent and often less than 0.1 percent.

Inhibitors and Antirust Additives

Antirust additives (or corrosion inhibitors) are additives that protect lubricated metal surfaces against chemical attack by water or other contaminants. A wide variety of these are commercially available; they are referred to in Klamann in "Lubricants and Related Products", op cit.

One type of antirust additive is a polar compound that wets the metal surface preferentially, protecting it with a film of oil. Another type of antirust additive absorbs water by incorporating it in a water-in-oil emulsion so that only the oil touches the metal surface. Yet another type of antirust additive chemically adheres to the metal to produce a non-reactive surface. Examples of suitable additives include zinc dithiophosphates, metal phenolates, basic metal sulfonates, fatty acids and amines. Such additives may be used in an amount of about 0.01 to 5 wt %, preferably about 0.01 to 1.5 wt %.

Friction Modifiers

A friction modifier is any material or materials that can alter the coefficient of friction of a surface lubricated by any lubricant or fluid containing such material(s). Friction modifiers, also known as friction reducers, lubricity agents, or oiliness agents, and other such agents that change the ability of base oils, formulated lubricant compositions, or functional fluids, to modify the coefficient of friction of a lubricated surface may be effectively used in combination with the base oils or lubricant compositions of the present invention if desired. Friction modifiers that lower the coefficient of friction are particularly advantageous in combination with the base oils and lube compositions of this invention. Friction modifiers may include metal-containing compounds or materials as well as ashless compounds or materials, or mixtures thereof. Metal-containing friction modifiers may include metal salts or metal-ligand complexes where the metals may include alkali, alkaline earth, or transition group metals. Such metal-containing friction modifiers may also have low-ash characteristics. Transition metals may include Mo, Sb, Sn, Fe, Cu, Zn, and others. Ligands may include hydrocarbyl derivative of alcohols, polyols, glycerols, partially esterified glycerols, thiols, carboxylates, carbamates, thiocarbamates, dithiocarbamates, phosphates, thiophosphates, dithiophosphates, amides, imides, amines, thiazoles, thiadiazoles, dithiazoles, diazoles, triazoles, and other polar molecular functional groups containing effective amounts of O, N, S, or P, individually or in combination. In particular, Mo-containing compounds can be particularly effective, as for example Mo-dithiocarbamates, Mo(DTC), Mo-dithiophosphates, Mo(DTP), Mo-amines, Mo (Am), Mo-alcoholates, Mo-alcohol-amides, etc. See U.S. Pat. Nos. 5,824,627; 6,232,276; 6,153,564; 6,143,701; 6,110,878; 5,837,657; 6,010,987; 5,906,968; 6,734,150; 6,730,638; 6,689,725; 6,569,820; WO 99/66013; WO 99/47629; WO 98/26030.

Ashless friction modifiers may also include lubricant materials that contain effective amounts of polar groups, for example, hydroxyl-containing hydrocarbyl base oils, glycerides, partial glycerides, glyceride derivatives, and the like. Polar groups in friction modifiers may include hydrocarbyl groups containing effective amounts of O, N, S, or P, individually or in combination. Other friction modifiers that may be particularly effective include, for example, salts (both ash-containing and ashless derivatives) of fatty acids, fatty alcohols, fatty amides, fatty esters, hydroxyl-containing fatty carboxylates, and comparable synthetic long-chain hydrocarbyl acids, alcohols, amides, esters, hydroxy carboxylates, and the like. In some instances fatty organic acids, fatty amines, and sulfurized fatty acids may be used as suitable friction modifiers.

Useful concentrations of friction modifiers may range from about 0.01 to 10-15 wt % or more, often with a preferred range of about 0.1 to 5 wt %. Concentrations of molybdenum-containing friction modifiers are often described in terms of Mo metal concentration. Advantageous concentrations of Mo may range from about 10 to 3000 ppm or more, and often with a preferred range of about 20 to 2000 ppm, and in some instances a more preferred range of about 30 to 1000 ppm. Friction modifiers of all types may be used alone or in mixtures with the materials of this invention. Often mixtures of two or more friction modifiers, or mixtures of friction modifier(s) with alternate surface active material(s), are also desirable.

Typical Additive Amounts

When lubricating oil compositions contain one or more of the additives discussed above, the additive(s) are blended into the composition in an amount sufficient for it to perform its intended function. Typical amounts of such additives useful in the present invention are shown in Table 1 below.

Note that many of the additives are shipped from the manufacturer and used with a certain amount of a base oil diluent in the formulation. Accordingly, the weight amounts in the table below, as well as other amounts mentioned in this text, are directed to the amount of active ingredient (that is the non-diluent/diluent portion of the ingredient) unless otherwise indicated. The weight percent indicated below are based on the total weight of the lubricating oil composition.

TABLE 1

Typical Amounts of Various Lubricant Oil Components

| Compound | Approximate Wt % (useful) | Approximate Wt % (preferred) |
|---|---|---|
| Detergent | 0.01-6 | 0.01-4 |
| Dispersant | 0.1-20 | 0.1-8 |
| Friction Reducer | 0.01-5 | 0.01-1.5 |
| Viscosity Index Improver | 0.0-40 | 0.01-30, more preferably 0.01-15 |
| Antioxidant | 0.01-5 | 0.01-1.5 |
| Corrosion Inhibitor | 0.01-5 | 0.01-1.5 |
| Anti-wear Additive | 0.01-6 | 0.01-4 |
| Pour Point Depressant | 0.0-5 | 0.01-1.5 |
| Anti-foam Agent | 0.001-3 | 0.001-0.15 |
| Base Oil | Balance | Balance |

EXAMPLES

Example 1

A base sample of GTL heavy base stock KV @100° C. of 13 cSt, VI ~150, cloud point +7° C., pour point −25° C., $T_{10}$ 956° F., $T_{50}$ 1065° F. and $T_{99}$ 1272° F., was evaluated for comparison purposes and used as the base oil for evaluation of various additives and additive mixtures for their utility as ambient temperature haze mitigation additives.

The GTL HBS was heated to 80° C. and cooled to and held at +20° C. and analyzed for turbidity as a measure of haze. The sample was measured at room temperature then put into a 20° C. incubator. NTU was measured using a HACH Model 2100® according to manufacture recommended testing procedure. Within a day of heating and cooling to 20° C. the NTU value was 1.48. After two weeks at 20° C. the NTU was 2.10 while after about 25 days at 20° C. the NTU was 2.5 prior to flocculation occurring.

To fresh individual samples of this GTL HBS base oil was added various, known conventional pour point depressants, wax anti-settling additives, cloud point depressants, as well as polymeric viscosity index improver, and polymeric defoamants.

The various additives are described below.

Additive Polymer I (Diesel fuel Cloud Point Depressant). R511®, believed to be an alkylated fumarate/vinyl acetate copolymer, AMW ~60,000, alkyl chains average $C_{12}$, no nitrogen:

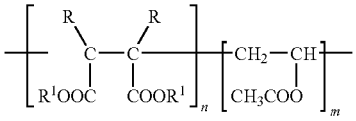

R=H,

R1=$C_6$ to $C_{18}$ (average $C_{12}$),

N+m=sufficient to result in the copolymer having a weight AMW of ~60,000, 49% active ingredient as received Additive Polymer D (a) (Wax Anti-settling Additive). R446®, believed to be an alkylated fumarate/vinyl acetate where ester groups have been reacted with amines to form amides (about 10-20% amides); average molecular around 60,000 having the formula:

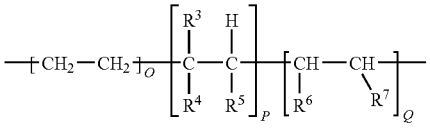

wherein:

Nitrogen content is 0.57 wt %

$R^3$=H, —$CH_3$ $R^4$=either or both of —$OOCR^7$ and —$COOR^7$ $R^5$=—H, or $COOR^7$ $R^6$ is any or all of $CONHR^7$ or pyridine or pyrrolidine $R^7$=any or all H, $C_1$-$C_{18}$ alkyl O=0 to 100, P and Q are integers independently ranging from 10 to 100, 37% active ingredient as received.

Additive J (Friction Modifier). Glycerol monostearate (100% active ingredient):

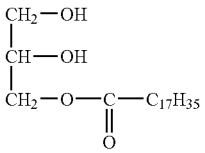

Additive D(b) (Diesel fuel Cloud Point Depressant). R434® believed to be alkylated fumarate/vinyl acetate copolymers, esters reacted with aromatic amines to give amides, contains 1.75 wt % nitrogen:

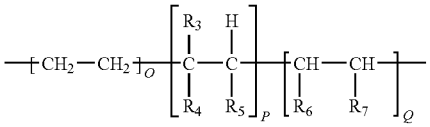

$R^3$=—H, —$CH_3$ $R^4$=either or both of —$OOCR^7$ and —$COOR^7$ $R^5$=—H, or $COOR^7$ $R^6$ is any or all of $CONHR^7$ or pyridine or pyrrolidine.

$R^7$=dodecyl phenol

O=0, or ranging from 10 to 100, and P and Q are integers independently ranging from 10 to 100 for a weight average molecular weight of about 40,000 to 60,000, 45-50% active ingredient as received.

Tripropylene Glycol Methyl Ester (additive "a"). The chemical structure is presented below:

$CH_3O(C_3H_6O)_3H$

Additive F (Pour Point Depressant). Lz7716® (F(a)) or Lz7719® (F(b)) poly methacrylate ester:

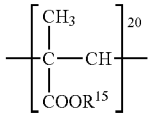

$R^{15}$=$C_6$-$C_{30}$, when n is sufficient to give a polymer having a weight average molecular weight of from about 20,000 to about 75,000, 50-60% active ingredient as received.

Viscosity Index Improver additive "b". Poly acrylate ester

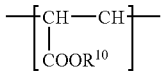

$R^{10}$=mixture of n-$C_6$ and $C_{12}$ alkyl groups, weight average molecular weight 50,000 to 75.000;

Additive E (Pour Point Depressant). V-387®, believed to be an alkylated fumarate/vinyl acetate copolymer, weight AMW of 65,000, no nitrogen of the following formula:

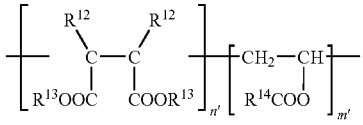

$R^{12}$=H $R^{13}$=$C_4$-$C_{10}$ (average $C_6$)

$R^{14}$=$C_1$ to $C_{12}$ alkyl and mixtures thereof, preferably methyl $n^1$+$m^1$ sufficient to give a weight average molecular weight of about 65,000, 45-50% active ingredient as received Additive "c" (Cloud Point Depressant). Polymeric alkyl fumarate esters

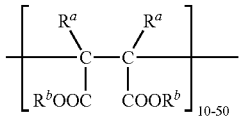

$R^a$=H, $R^b$=$C_6$ to $C_{30}$

Additive "d" (Cloud Point Depressant). Polymeric alkyl fumarate ester

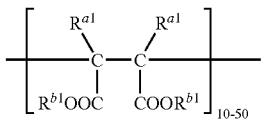

$R^{a1}$=—H, —$C_1$ to —$C_{10}$ $R^{b1}$=—$C_6$ to —$C_{30}$

Additive "e" (Polydimethylsiloxane)

Additive "f" (50/50 mixture of Additive I and Additive D(a))

Additive "g" (50/50 mixture of Additive I and Additive J)

The results are presented in the Table 1 below:

TABLE 2

| Base Oil | Additive/Amount | Haze | NTU |
|---|---|---|---|
| GTL HBS | None | Yes | 2.10 at 14 days<br>2.55 at 25 days |
| GTL HBS | I/500 ppm | C&B | <1 at 21 days* |
| GTL HBS | D(a)/500 ppm | yes <1 day | >4 at 1 day |
| GTL HBS | J/500 ppm | clear for 6 days<br>haze on 7th day | 2.69 at 7 days |
| GTL HBS | D(b)/500 ppm | haze is day 1 | 1.93<br>2.55 at 14 days |
| GTL HBS | a/500 Ppm | haze after day 1 | 2.92 at 7 days |
| GTL HBS | F(a)/100 ppm | haze after day 1 | 5.02 at 1 day |
| GTL HBS | F(b)/100 ppm | haze after day 1 | 7.37 at 1 day |
| GTL HBS | B/500 ppm | Haze | 2.2 at 5 days |
| GTL HBS | E/500 ppm | haze on day 1 | 2.29 at 1 day |
| GTL HBS | c/500 Ppm | haze appeared rapidly | 8.23 at 1 day |
| GTL HBS | D/500 ppm | C&B after 1 week | 1.22 at 14 days;<br>2.98 at 21 days |
| GTL HBS | e/1000 ppm | haze after 1-2 days | 1.97 |
| GTL HBS | f/1000 ppm | C&B | 1.02 at 41 days* |
| GTL HBS | g/1000 ppm | C&B after 14 days | 0.25 at 14 days<br>0.46 at 21 days* |

In Table 2 different portions of the same GTL HBS stock were additized with the additives indicated at the treat level indicated (additive used as received). Haze was determined by visual inspection of the samples standing at room temperature for the time periods indicated. NTU was determined using a HACH model 2100® employed following manufacturer's recommended procedure. A pass is indicated when the sample remains clear and bright and exhibits a NTU of about 2.0 or less for at least 13-14 days, preferably about 1 or less for at least 21 days. Those samples identified with an * are within the scope of the present invention.

Example 2

Small scale filterability tests were performed on a number of the above recited samples. The filtration experiment primarily measures the time required to filter a give amount of stock, after being diluted with naphtha, through a 0.8 micron filter.

TABLE 3

| Stock | Filtration Time |
|---|---|
| GTL HBS | 409 seconds |
| GTL HBS + 500 ppm Additive I | 77 seconds |
| GTL HBS + 500 ppm Additive D(a) | 278 seconds |
| GTL HBS + 500 ppm Additive J | 245 seconds |
| GTL HBS + 5000 ppm Additive J | >1800 seconds |
| GTL HBS + 1000 ppm Additive "f" | >1800 seconds |
| GTL HBS + 1000 ppm Additive "g" | >1800 seconds |

As is seen of all the additives evaluated for their effect on filterability, only Additive I achieved both an improvement in filterability as compared to the GTL HBS per se and produced a clear and bright result with a NTU of <1 after 21 days.

Dispersed haze in a liquid is subject to some level of inherent inhomogeniety. The haze fraction has a slightly higher density than the liquid and as such is subject to settling with time. While efforts are made to take representative samples (such as reheating and stirring), sub-samples of the same batch will occasionally exhibit different levels of turbidity. This does not mean that the haze is different or more or less amenable to interactions with additives. In cases where additives have actually been tested on other batches that are actually lower in haze, no advantage has been seen for the lower haze in terms of effectiveness of the additive in mitigating the haze.

All of the following examples were conducted using the Light Scattering measurement procedure described below:

Preparation and Storage of Blends

The GTL base stock was heated (80° C.) and stirred under nitrogen for 2 hr to melt any wax crystals and to ensure homogeneity of the base stock. After the addition of an appropriate amount of additive to the heated base stock the solution was heated (80° C.) and stirred for an additional 20 min. The additized GTL base stock blends were dispensed (four replicates per blend) into optically transparent and disposable polystyrene microwell plates which have an x-y array of 96 (12×8) sample wells (250 μl sample per well). The microwell plates were transferred into temperature controlled thermal blocks and stored at 20° C.+/−1° C. for the duration of the study.

Light Scattering Measurements

The Microwell plates are used and measured sequentially by using a stepping mechanism. The Nepheloskan Ascent by Thermo Electron, was employed. It is a microplate nephelometer that measures particles in solution by measuring the light scattered by the particles. In this instrument the optical system consists of a light source (quartz-halogen lamp) and an optical filter (580-630 nm) below the microplate that focuses a light beam 2 mm in diameter in the sample. A second filter above the sample only allows the scattered light at a 30° angle to pass towards the detector, a photomultiplier tube (PMT) above the microplate.

The intensity of scattered light measured in the Nepheloskan Ascent microwell plate reader is expressed as relative nephelometric units (RNU). Nepheloskan Ascent scattered light intensity was correlated to nephelometric turbidity units (NTU) with NIST turbidity standards (Amco Clear GFS Chemicals, Inc), Table 4. Three expert raters rated the appearance of these turbidity standards as follows: 10 NTU standard=slight trace haze; 20 NTU standard=trace haze. All the samples in this study were measured at 20° C.+/−1° C., with a lamp voltage of 12 and PMT voltage of 300. Intensity values are an average of 8 replicates.

TABLE 4

| NTU | Intensity (in RNU) | 95% Confidence Level |
|---|---|---|
| 0 | 0.43 | +/−0.03 |
| 1 | 0.62 | +/−0.04 |
| 1.5 | 0.65 | |
| 2 | 0.69 | +/−0.04 |
| 4 | 0.85 | +/−0.06 |
| 6 | 0.97 | +/−0.06 |
| 8 | 1.19 | +/−0.03 |
| 10 | 1.27 | +/−0.03 |
| 20 | 1.97 | +/−0.03 |
| 200 | 18.47 | +/−0.30 |

All of the following Examples used samples of GTL HBS (KV at 100° C. of 14 $mm^2/s$) secured from the same batch of material. The unadditized GTL HBS exhibited base line haze readings ranging from about 8 to about 15 Intensity in RNU after 13 days at 20° C.±1° C.

Example 3

Numerous traditional wax crystal modifiers, pour-point depressants, cloud point depressants, wax anti-settling additives were investigated. Despite the fact that the haze in the GTL HBS is attributable to the presence of wax in the oil, the wax responsible for causing the formation of haze in the GTL did not respond to the traditional wax modifiers which have typically been employed to address the problems associated with the presence of wax in lubricating oils. The traditional wax modifier additives were evaluated at 500 ppm and 1000 ppm (as received) dose levels in the GTL HBS. The mean results of 8 replicates (two experiments, 4 replicates per experiment) after 13 days is presented below.

TABLE 5

| Intensity (in RNU) after 13 days | | | |
|---|---|---|---|
| | % active ingredient | 500 PPM | 1000 PPM |
| Polybutadiene block polyisoprene 1,3-butadiene | 20% in toluene | 18.37 | 63.11 |
| Poly (ethyl vinyl ether) | 100 | 10.52 | 9.69 |
| Poly (vinyl stearate) | 100 | 43.61 | 52.75 |
| Ketjenlube 19[(1)] | 100 | 14.42 | 13.08 |
| Polyethylene mono alcohol | 100 | 34.77 | 79.39 |
| Ketjen lube DX 3000[(2)] | 100 | 12.45 | 11.28 |
| Poly (ethylene glycol monooleate) | 100 | 9.36 | 10.02 |
| Salicylic Acid | 100 | 49.35 | 53.45 |
| 15 Crown - 5[(3)] | 98 | 12.85 | 11.51 |
| R188[(9)] | 40-50 | 18.28 | 3.46 |
| R434 ($R^7$ is alkyl phenol)[(4)] | 45-50 | 20.93 | 21.70 |
| V387[(5)] | 45-55 | 24.44 | 16.56 |
| LZ 7716[(6)] | 50 | 13.06 | 14.45 |
| R446[(7)] | 37 | 23.80 | 23.60 |
| LZ 7719[(6)] | 60 | 7.15 | 11.28 |
| P5090[(10)] | 30-45 | 26.03 | 39.90 |
| EVA 801[(11)] | 100 | 9.21 | 15.61 |
| EVA 802[(11)] | 100 | 12.19 | 18.87 |
| EVA 806[(11)] | 100 | 14.40 | 16.13 |
| Lz7949 B[(12)] | 65 | 14.93 | 12.39 |
| Viscoplex 1-330/333[(13)] | 60-85 | 22.79 | 26.28 |
| Viscoplex 1-154[(13)] | 30-60 | 14.58 | 10.02 |
| Viscoplex 8-219[(13)] | 60-85 | 24.17 | 28.21 |
| Viscoplex 0-220[(13)] | 60-85 | 14.81 | 16.33 |
| Viscoplex 6-054[(13)] | 65-75 | 12.31 | 16.33 |
| Dodiflow[(8)] | 50% in naphtha | 1.83 | 3.67 |

[(1)]see polymer A previously defined

[(2)]a $C_8$-$C_{10}$ alpha olefin 2-ethyl hexyl fumarate ester copolymer

[(3)]see polymer C previously defined

[(4)]see polymer D(b) previously defined, where $R^7$ is dodecyl phenol and nitrogen content is 1.75 wt %. It is a diesel fuel cloud point depressant.

[(5)]see polymer E previously defined.

[(6)]see polymer F, previously described

[(7)]see polymer D(a), where $R^7$ is H; $C_1$ to $C_{18}$ alkyl group and nitrogen content is 0.57 wt %.

[(8)]see polymer K previously defined.

[(9)]Infineum R 188 ® is a cloud point depressant used in diesel fuels. It is an n-$C_{16}$ and n-$C_{18}$ (Tallow) fumarate ester vinyl acetate.

[(10)]P 5090 is Infineum Paraflow 5090 ® which is a calcium alkyl salicylate detergent. Alkyl groups are linear C12 to C16.

[(11)]EVA 801 ®, EAV 802 ® and EVA 806 ® are a polyethylene vinyl acetate copolymers.

[(12)]7949B ® is Lubrizol 7949B ® a pour point depressant and is a poly[methacrylate] ester. (Polymer F)

[(13)]Viscoplex materials are all poly[methacrylate]esters. They differ by their average molecular weight and R alkyl groups.

For a sample to have an NTU value of 2 or less after 13 days the sample would need to exhibit an Intensity (RNU) after 13 days of about 0.69±0.04 after 13 days, according to the criterion established in Table 3. As is seen from Table 4, none of the traditional wax modifiers tested were effective in reducing the Intensity (RNU) to about 0.69±0.04. Thus, none reduced haze to an NTU value of 2 or less after 13 days.

Example 4

Five hundred wppm of Polymer I a diesel fuel cloud point depressant employed as received (49% active ingredient) was added to a sample of GTL heavy base stock (KV @100° C.=14 mm2/s) which when analyzed unadditized, exhibited a base line Intensity (RNU) of about 14.0±2.35 at 20° C.±1° C. After 13 days the additized sample exhibited an intensity of 0.58, after 90 days an intensity of 1.80 and after 174 days an intensity of 2.00 (mean of 4 replicates).

Example 5

One thousand wppm of Polymer I (as received) was added to a fresh sample of the same GTL HBS of Example 3. After 13 days the additized sample exhibited an intensity of 0.56 while after 90 days the same exhibited an intensity of 1.41, and after 174 days an intensity of 1.70 (mean of 4 replicates).

Example 6

Five hundred wppm of Polymer II a diesel fuel cloud point depressant employed as received (40-60% active ingredient in naphtha) was added to a fresh sample of the same GTL HBS of Example 3. After 13 days the additized sample exhibited an intensity of 0.48, after 82 days an intensity of 0.66, after 90 days an intensity of 0.69, after 174 days an intensity of 1.57 (mean of 4 replicates).

Example 7

One thousand wppm of Polymer II (as received) was added to a fresh sample of the same GTL HBS of Example 3. After 13 days the additized sample exhibited an intensity of 0.52 but after 82 days the intensity rose to 1.75 and at 90 days it was 1.85, after 174 days an intensity of 6.32 (mean of 4 replicates).

Example 8

One thousand wppm of Polymer III (as received 75% active ingredient in xylene) was added to a fresh sample of the same GTL HBS of Example 3. After 13 days the additized sample exhibited an intensity of 2.52, after 82 days an intensity of 2.32, after 90 days an intensity of 2.37, after 174 days an intensity of 2.36 (mean of 4 replicates).

Example 9

Five hundred wppm of Polymer III (as received) was added to a fresh sample of the same GTL HBS of Example 3. After 13 days the additized sample exhibited an intensity of 1.13 which after 68 days had risen to 1.62, after 82 days to 149, after 90 days to 139, after 174 days to 141 (mean of 4 replicates).

Example 10

Five hundred wppm of Polymer K (Dodiflow) a diesel fuel cloud point depressant (50% active ingredient in naphtha as received) was added to a fresh sample of the same GTL HBS of Example 3. After 13 days the additized sample exhibited an intensity of 1.24 after 68 days an intensity of 1.68, after 82 days an intensity of 1.63, after 90 days an intensity of 1.52, after 174 days an intensity of 1.71 (mean of 4 replicates).

Example 11

One thousand wppm of Polymer K (Dodiflow) a diesel fuel cloud point depressant employed as received (50% active ingredient in naphtha) was added to a fresh sample of the same GTL HBS of Example 3. After 13 days the additized sample exhibited an intensity of 2.56, after 68 days an intensity of 3.22, after 82 days an intensity of 3.07, after 90 days an intensity of 2.92, after 174 days an intensity of 1.13 (flocculation) (mean of 4 replicates).

Example 12

Five hundred vppm of Polymer I (as received) and 500 vppm of different second additives (individually) (as received) to give a total treat level of 1000 vppm, was added to fresh samples of the same GTL HBS of Example 3. After 13 days the additized samples exhibited the intensity values (mean of 4 replicates) reported in following Table 6.

TABLE 6

| | Intensity | Rating |
|---|---|---|
| Polymer I + Polymer III | 1.05 | F |
| Polymer I + polybutediene block polyisoprene 1,3-butadiene | 7.36 | F |
| Polymer I + poly(ethyl vinyl ether) (Polymer B) | 0.56 | P |
| Polymer I + poly (vinyl stearate) | 8.13 | F |
| Polymer I + Ketjen Lube 19 (Polymer A) | 0.57 | P |
| Polymer I + polyethylene mono alcohol | 112.0 | F |
| Polymer I + Ketjen Lube DX 3000 | 1.12 | F |
| Polymer I + poly (ethylene glycol monooleate) | 1.40 | F |
| Polymer I + salicyclic acid | 64.10 | F |
| Polymer I + 15 Crown - 5 (Polymer C) | 0.63 | P |
| Polymer I + R188 | 2.28 | F |
| Polymer I + Polymer D (b) | 0.61 | P |
| Polymer I + Polymer E V387 | 0.68 | P |
| Polymer I + Polymer F LZ7716 | 0.60 | P |
| Polymer I + Polymer D (a) R446 (N 0.57 wt %) | 0.56 | P |
| Polymer I + Polymer F LZ7719 | 0.60 | P |
| Polymer I + P 5090 | 11.04 | F |
| Polymer I + EVA 801 | 18.05 | F |
| Polymer I + EVA 802 | 14.07 | F |
| Polymer I + EVA 806 | 5.80 | F |
| Polymer I + Lz 7949 B (Polymer F) | 0.62 | P |
| Polymer I + Viscoplex 1-330/333 | 0.70 | P |
| Polymer I + Viscoplex 1-154 | 0.57 | P |
| Polymer I + Viscoplex 8-219 | 0.93 | F |
| Polymer I + Viscoplex 0-220 | 0.69 | P |
| Polymer I + Viscoplex 6-054 | 0.71 | P |
| Polymer I + Polymer II | 0.56 | P |
| Polymer I + Polymer K | 1.44 | F |

F = fail, did not have an NTU after 13 days of 2.0 or less as evidenced by an Intensity measurement of greater than 0.69 ± 0.04 after 13 days..
P = pass, had an NTU after 13 days of 2.0 or less as evidenced by an Intensity measurement of 0.69 ± 0.04 or less after 13 days.

Example 13

Five hundred vppm of Polymer II (as received) and 500 vppm of different second additives (individually) (as received) to give a total treat level of 1000 vppm, was added to fresh samples of the same GTL HBS of Example 3. After 13 days the additized samples exhibited the intensities values (mean of 4 replicates) reported in the following Table 7.

TABLE 7

| | Intensities | Rating |
|---|---|---|
| Polymer II + Polymer III | 1.14 | F |
| Polymer II + polybutediene block polyisoprene 1,3-butadiene | 5.47 | F |
| Polymer II + poly(ethyl vinyl ether) (Polymer B) | 0.50 | P |
| Polymer II + poly (vinyl stearate) | 7.88 | F |

TABLE 7-continued

| | Intensities | Rating |
|---|---|---|
| Polymer II + Ketjen Lube 19 (Polymer A) | 0.50 | P |
| Polymer II + polyethylene mono alcohol | 82.39 | F |
| Polymer II + Ketjen Lube DX 3000 | 0.82 | F |
| Polymer II + poly (ethylene glycol monooleate) | 1.82 | F |
| Polymer II + salicyclic acid | 89.63 | F |
| Polymer II + 15 Crown - 5 (Polymer C) | 0.59 | P |
| Polymer II + R188 | 2.38 | F |
| Polymer II + Polymer I | 0.56 | P |
| Polymer II + Polymer D(b) 434 | 0.69 | P |
| Polymer II + Polymer E V387 | 0.46 | P |
| Polymer II + Polymer F LZ7716 | 0.55 | P |
| Polymer II + Polymer D(a) R446 | 2.00 | F |
| Polymer II + Polymer F LZ7719 | 0.47 | P |
| Polymer II + P 5090 | 25.79 | F |
| Polymer II + EVA 801 | 8.60 | F |
| Polymer II + EVA 802 | 7.16 | F |
| Polymer II + EVA 806 | 4.20 | F |
| Polymer II + Lz 7949 B (Polymer G) | 0.46 | P |
| Polymer II + Viscoplex 1-330/333 | 0.49 | P |
| Polymer II + Viscoplex 1-154 | 0.58 | P |
| Polymer II + Viscoplex 8-219 | 0.84 | F |
| Polymer II + Viscoplex 0-220 | 0.47 | P |
| Polymer II + Viscoplex 6-054 | 0.45 | P |
| Polymer II + Polymer K | 3.63 | F |

Example 14

Five hundred vppm of Polymer III (as received) and 500 vppm of different second additives (individually) (as received) to give a total treat level of 1000 vppm was added to fresh samples of the same GTL HBS of Example 3. After 13 days the additized samples exhibited the intensities (mean of 4 replicates) reported in the following Table 7.

TABLE 8

| | Intensities | Rating |
|---|---|---|
| Polymer III + polybutediene block polyisoprene 1,3-butadiene | 10.00 | F |
| Polymer III + poly(ethyl vinyl ether) (Polymer B) | 2.92 | F |
| Polymer III + poly (vinyl stearate) | 6.86 | F |
| Polymer III + Ketjen Lube 19 (Polymer A) | 1.09 | F |
| Polymer III + polyethylene mono alcohol | 140.20 | F |
| Polymer III + Ketjen Lube DX 3000 | 1.76 | F |
| Polymer III + poly (ethylene glycol monooleate) | 5.00 | F |
| Polymer III + salicyclic acid | 99.31 | F |
| Polymer III + 15 Crown - 5 (Polymer C) | 1.36 | F |
| Polymer III + R188 | 2.51 | F |
| Polymer III + Polymer I | 1.05 | F |
| Polymer III + Polymer D(b) | 1.38 | F |
| Polymer III + Polymer E V387 | 1.27 | F |
| Polymer III + Polymer F LZ7716 | 1.12 | F |
| Polymer III + Polymer D(a) R446 | 1.86 | F |
| Polymer III + Polymer F LZ7719 | 1.06 | F |
| Polymer III + P 5090 | 9.26 | F |
| Polymer III + EVA 801 | 19.14 | F |
| Polymer III + EVA 802 | 17.62 | F |
| Polymer III + EVA 806 | 8.39 | F |
| Polymer III + Lz 7949 B (Polymer G) | 1.20 | F |
| Polymer III + Viscoplex 1-330/333 | 1.32 | F |
| Polymer III + Viscoplex 1-154 | 1.14 | F |
| Polymer III + Viscoplex 8-219 | 2.19 | F |
| Polymer III + Viscoplex 0-220 | 1.31 | F |
| Polymer III + Viscoplex 6-054 | 0.56 | P |
| Polymer III + Polymer II | 1.14 | F |
| Polymer III + Polymer K | 2.87 | F |

Example 15

Five hundred vppm of Polymer K (as received) and 500 vppm of different second additives (individually) (as received) to give a total treat level of 1000 vppm was added to fresh samples of the same GTL HBS of Example 3. After 13 days the additized samples exhibited the intensities (mean of 4 replicates) reported in the following Table 8.

TABLE 9

| | Intensity | Rating |
|---|---|---|
| Polymer K + Polymer III | 2.87 | F |
| Polymer K + polybutediene block polyisoprene 1,3-butadiene | 7.04 | F |
| Polymer K + poly(ethyl vinyl ether) (Polymer B) | 1.30 | F |
| Polymer K + poly (vinyl stearate) | 6.51 | F |
| Polymer K + Ketjen Lube 19 (Polymer A) | 1.33 | F |
| Polymer K + polyethylene mono alcohol | 82.77 | F |
| Polymer K + Ketjen Lube DX 3000 | 1.78 | F |
| Polymer K + poly (ethylene glycol monooleate) | 2.29 | F |
| Polymer K + salicyclic acid | 87.35 | F |
| Polymer K + 15 Crown - 5 (Polymer C) | 1.19 | F |
| Polymer K + R188 | 2.67 | F |
| Polymer K + Polymer I | 1.44 | F |
| Polymer K + Polymer D(b) | 0.68 | P |
| Polymer K + Polymer E V387 | 1.42 | F |
| Polymer K + Polymer F LZ7716 | 1.34 | F |
| Polymer K + Polymer D(a) R446 | 0.78 | F |
| Polymer K + Polymer F LZ7719 | 1.28 | F |
| Polymer K + P 5090 | 20.63 | F |
| Polymer K + EVA 801 | 9.18 | F |
| Polymer K + EVA 802 | 7.77 | F |
| Polymer K + EVA 806 | 6.90 | F |
| Polymer K + Lz 7949 B (Polymer G) | 1.26 | F |
| Polymer K + Viscoplex 1-330/333 | 1.32 | F |
| Polymer K + Viscoplex 1-154 | 1.36 | F |
| Polymer K + Viscoplex 8-219 | 2.01 | F |
| Polymer K + Viscoplex 0-220 | 1.30 | F |
| Polymer K + Viscoplex 6-054 | 0.62 | P |
| Polymer K + Polymer II | 3.63 | F |

In the following Examples 17-20 there was an instrument malfunction at day 83; the temperature rose to 27° C. for 1.5 hours.

Example 16

Five hundred wppm of Polymer I (as received) was added to a fresh sample of the same GTL HBS of Example 3. The sample was aged over a period of 174 days and evaluated for intensity periodically over that period. The intensity value remained below 0.66 for 26 days then rose slowly to 4.22 at the end of the test period, (mean of 4 replicates until day 26, mean of 3 replicates from day 27 to end of test).

Example 17

One thousand wppm of Polymer I (as received) was added to a fresh sample of the same GTL HBS of Example 3. The sample was aged over a period of 174 days and evaluated for intensity periodically over that period. The intensity value remained below 0.73 for 33 days, then rose slowly to 2.29 at the end of the test period, (mean of 4 replicates until day 26, mean of 3 replicates from day 27 to end of test).

Example 18

Five hundred wppm of Polymer D(a) (as received) was added to a fresh sample of the same GTL HBS of Example 3. The sample was aged over a period of 174 days and evaluated for intensity periodically over that period. The intensity immediately upon addition was 1.28 and rose to 33.11 at 2 days. The intensity decreased over time (due to flocculation), reaching 2.10 at 89 days, ending at 1.76 at 174 days. Increasing the treat level of Polymer D(a) to 1000 wppm did not produce improved results, the intensity immediately upon addition being 0.70 but increasing to 33.11 at 2 days. The intensity decreased over time, reaching a low of 4.69 at 89 days, then fluctuated between 4.69 and 6.63 until the end of test, ending at 5.05 at 174 days. The low intensity values at 89 days can be attributed to an instrument malfunction which occurred at day 83 when the temperature rose to 27° C. for 1.5 hours (up from the 20° C.±1° C. test temperature). Regardless, Polymer D(a) by itself, failed to reduce the haze of the GTL to an acceptable level.

Example 19

Five hundred vppm of Polymer I (as received) combined with 500 vppm of Polymer D(a) (as received) to give a total treat level of 1000 vppm was added to a fresh sample of the same GTL HBS of Example 3. The sample was aged over a period of 174 days and evaluated for intensity periodically over that period. The intensity values over the period fluctuated between 0.56 to 0.97, showing a gradual increase over time but staying at about 0.7 (with a single incursion to 0.83 at day 30 following transfer to new plates on day 28) over a period of about 90 days as shown in Table 10.

TABLE 10

| Time (days | 0 | 5 | 7 | 13 | 21 | 30 | 35 | 57 | 62 | 68 | 76 | 82 | 89 | 90 | 104 | 118 | 146 | 174 |
|---|---|---|---|---|---|---|---|---|---|---|---|---|---|---|---|---|---|---|
| Polymer I + Polymer D(a) | 0.63 | 0.59 | 0.61 | 0.56 | 0.65 | 0.83 | 0.67 | 0.66 | 0.66 | 0.77 | 0.72 | 0.71 | 0.72 | 0.76 | 0.89 | 0.79 | 0.84 | 0.97 |

Example 20

One thousand wppm of Polymer II (as received) was added to a fresh sample of the same GTL HBS of Example 3. After 13 days the additized sample exhibited an intensity of 0.52, after 26 days the intensity had risen to 0.68 and at 34 days to 0.80, at 90 days to 1.85, at 146 days to 4.16 and at 174 days to 6.32.

Example 21

Five hundred wppm of Polymer II (as received) was added to a fresh sample of the same GTL HBS of Example 3. After 13 days the additized sample exhibited an intensity of 0.48; after 90 days it had risen to only 0.69, at 146 days to 0.86 and at 174 days to 1.57.

Example 22

Five hundred vppm of Polymer II (as received) and 500 vppm of different second additives (individually) (as received) to give a total treat level of 1000 vppm, was added to fresh samples of the same GTL HBS of Example 3. The samples were aged for a period of 90 days and evaluated periodically for intensity. The results are presented in Table 11.

TABLE 11

| Intensity Over Time | | | | | | | | | | | |
|---|---|---|---|---|---|---|---|---|---|---|---|
| Time (days) | 0 | 7 | 13 | 21 | 34 | 57 | 68 | 90 | 118 | 146 | 174 |
| Polymer II + Polymer B | 0.75 | 0.53 | 0.50 | 0.48 | 0.49 | 0.48 | 0.50 | 0.49 | 0.52 | 0.52 | 0.55 |
| Polymer II + Polymer E | 0.50 | 0.49 | 0.46 | 0.46 | 0.47 | 0.48 | 0.52 | 0.56 | 0.76 | 0.78 | 0.77 |
| Polymer II + Polymer A | 0.58 | 0.52 | 0.50 | 0.51 | 0.51 | 0.53 | 0.54 | 0.54 | 0.54 | 0.55 | 0.58 |
| Polymer II + Polymer F (LZ7716) | 0.61 | 0.56 | 0.55 | 0.58 | 0.55 | 0.56 | 0.60 | 0.64 | 0.65 | 0.67 | 0.72 |
| Polymer II + Viscoplex 0-220 | 0.51 | 0.47 | 0.47 | 0.47 | 0.49 | 0.55 | 0.60 | 0.62 | 0.67 | 0.70 | 0.76 |
| Polymer II + Ketjenlube DX3000 | 0.90 | 0.87 | 0.82 | 0.83 | 0.80 | 0.77 | 0.78 | 0.69* | 0.75 | 0.67 | 0.72 |
| Polymer II + Viscoplex 6-054 | 0.52 | 0.47 | 0.45 | 0.47 | 0.47 | 0.51 | 0.54 | 0.59 | 0.59 | 0.59 | 0.62 |
| Polymer II + Polymer F (LZ7719) | 0.52 | 0.49 | 0.47 | 0.49 | 0.71 | 0.56 | 0.61 | 0.64 | 0.69 | 0.76 | 0.97 |
| Polymer II + Polymer C | 0.62 | 0.63 | 0.59 | 0.60 | 0.62 | 0.67 | 0.67 | 0.70 | 0.73 | 0.75 | 0.83 |
| Polymer II + Lz7749B(7949B?) | 0.55 | 0.50 | 0.46 | 0.50 | 0.58 | 0.52 | 0.56 | 0.63 | 0.66 | 0.71 | 0.78 |
| Polymer II + Viscoplex 1-330/333 | 0.53 | 0.54 | 0.49 | 0.52 | 0.53 | 0.57 | 0.61 | 0.66 | 0.85 | 1.31 | 2.44 |
| Polymer II + Viscoplex 1-154 | 0.58 | 0.60 | 0.58 | 0.58 | 0.58 | 0.64 | 0.67 | 0.70 | 0.82 | 1.07 | 1.93 |

*due to flocculation.

Example 23

Five hundred wppm of Polymer III (as received) was added to a fresh sample of the same GTL HBS of Example J. Immediately upon addition the intensity was 0.65 rising to 0.73 on day 2 and 0.90 on day 5. After 13 days the intensity was 1.13. It fluctuated between 1.51 and 1.62 for day 40 to 76, then 1.49 on day 82, 1.39 on day 90, 1.31 on day 118, 1.28 on day 146 and 1.41 on day 174. Increasing the treat level to 1000 wppm of polymer III (as received) did not result in an improvement, the intensity being 1.32 on day 2 then fluctuating between 1.94 and 3.13 between days 5 to 90, reaching the high of 3.13 on day 29, then decreasing to 2.37 on day 90, 2.16 on day 118, 2.27 on day 146 and 2.36 on day 174.

Example 24

Five hundred vppm of Polymer III (as received) and 500 vppm of viscoplex 6-054 (as received) was added to a fresh sample of the same GTL HBS of Example 3. The sample was evaluated periodically for intensity over 174 days. The intensity ranged from 0.57 to 0.73 over the duration of the 90 day test period as shown in Table 12.

TABLE 12

| Time (days) | 0 | 5 | 7 | 13 | 21 | 34 | 57 | 68 | 90 | 118 | 146 | 174 |
|---|---|---|---|---|---|---|---|---|---|---|---|---|
| Polymer III + Viscoplex 6-054 | 0.57 | 0.60 | 0.63 | 0.56 | 0.63 | 0.64 | 0.67 | 0.70 | 0.73 | 0.71 | 0.72 | 0.77 |

Example 25

Five hundred wppm of Polymer K (as received) was added to a fresh sample of the same GTL HBS of Example 3. Upon addition the sample exhibited an intensity of 0.68, rising to 0.98 on day 2 and to 1.08 on day 5.

Example 26

Five hundred wppm of Polymer D(b) (as received) was added to a fresh sample of the same GTL HBS of Example 3. Upon addition the sample exhibited an intensity of 4.60, rising to 19.91 on day 2. After 13 days the intensity was measured to be 18.88 increasing to 19.39 on day 21. When the evaluation was terminated on day 26 the intensity was 18.49.

Example 27

Five hundred vppm of Polymer K (as received) and 500 vppm of Polymer D(b) (as received) was added to a fresh sample of the same GTL HBS of Example 3. The sample was evaluated periodically for intensity over 174 days. The intensity ranged from 0.67 to 1.66 over the duration of the 174 day test period as shown in Table 13, giving satisfactory results (intensity of 0.69±0.04 (or less)) for up to 26 days.

TABLE 13

| Time (days) | 0 | 5 | 7 | 13 | 21 | 26 | 34 | 57 | 68 | 82 | 90 | 118 | 146 | 174 |
|---|---|---|---|---|---|---|---|---|---|---|---|---|---|---|
| Polymer K + Polymer D(b) | 0.69 | 0.68 | 0.71 | 0.68 | 0.73 | 0.72 | 0.75 | 0.80 | 0.83 | 0.90 | 0.89 | 0.94 | 0.99 | 1.68 |

What is claimed is:

1. A method for reducing the haze observed on standing at ambient temperature in Gas-to-liquids (GTL) base stock(s) and/or base oil(s) having a kinematic viscosity @100° C. of about 8 $mm^2/s$ or higher to a level evidencing an NTU value of about 2.0 NTU or less at 20° C.±1° C. for at least 13 days by the addition to the GTL base stock(s) and/or base oil(s) of an additive of polymer II which is a mixture of (a)

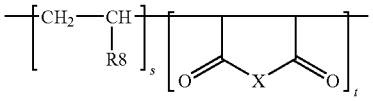

wherein $R^8$is $C_{10}$ to $C_{12}$alkyl and mixtures thereof, x is oxygen or nitrogen and s+t together are sufficient to produce the co-polymer having a weight average molecular weight of about 800 to about 1000, and (b)

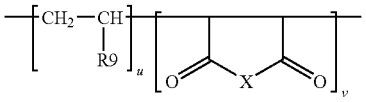

wherein $R^9$is $C_{12}$ to $C_{14}$alkyl and mixtures thereof,

X is oxygen or nitrogen wherein at least some percentage of x is nitrogen, and u and v together are sufficient to produce the copolymer having a weight average molecular weight of about 7000 to about 8,000 and (a) and (b) are in a ratio of about 60:40.

2. The method of claim 1 wherein the additive is added to the GTL base stock(s) and/or base oil(s) in an amount ranging from about 50 to 5000 ppm based on active ingredient.

3. The method of claim 1 wherein when the additive is polymer II (a) and (b) are in a ratio of about 55:45.

4. The method of claim 1 wherein the GTL base stock(s) and/or base oil(s) have a KV @100° C. of about 10 $mm^2/s$ or higher and the haze observed on standing at ambient temperature is reduced to a level evidencing on NTU value of about 1.5 NTU or less at 20° C.±1° C. for at least 30 days.

5. A method for reducing the haze observed on standing at ambient temperature in Gas-to-Liquids (GTL) base stock(s) and/or base oil(s) having a kinematic viscosity at 100° C. of about 8 $mm^2/s$ or higher to a level evidenced by on NTU value of about 2.0 NTU or less at 20° C.±1° C. for at least 13 days by the addition to the GTL base stock(s) and/or base oil(s) of an additive selected from the group consisting of a 4:1 to 1:4 mixture of a polymer of formula II II (polymer II) which is a mixture of a)

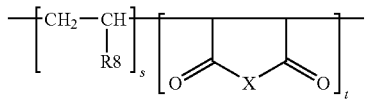

wherein $R^8$is $C_{10}$to $C_{12}$alkyl and mixtures thereof, x is oxygen or nitrogen, and s and t together are sufficient to produce the copolymer having a weight average molecular weight of about 800 to about 1000, and (b)

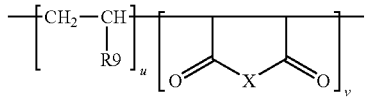

wherein $R^9$is $C_{12}$to $C_{14}$alkyl and mixtures thereof,

X is oxygen or nitrogen wherein at least some percentage of x is nitrogen, and u and v together are sufficient to produce the copolymer having a weight average molecular weight of about 7000 to about 8,000 and (a) and (b) are in a ratio of about 60:40, and a second polymer selected from the group consisting of A) $C_8$to $C_{12}$alpha olefin fumarate ester copolymer having a weight average molecular weight of from about 500 to about 20,000;

B) poly(ethyl vinyl ether) of about 3,000 to about 5,000 weight AMW;

C) 15-Crown-5 or (1,4,7,10,13-pentaoxacyclo pentadecane 98%),

D)

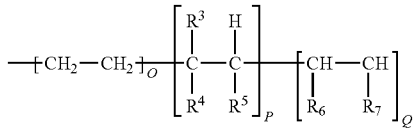

wherein $R^3$is selected from H or $CH_3$, $R^4$is either or both —$OOCR^7$or —$COOR^7$, $R^5$is H or $COOR^7$, $R^6$is —$CONHR^7$, or a 5 or 6 membered heterocyclic nitrogen containing ring which can contain one or more $C_1$to $C_3$alkyl groups, $R^7$is $C_1$to $C_{18}$alkyl phenol, wherein the total nitrogen content ranges from about 1.2 to 2.0 wt %,

E)

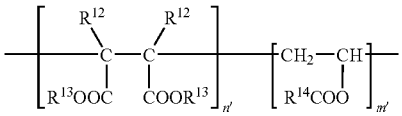

wherein $R^{12}$s are the same or different and are independently selected from H, $C_1$to $C_8$alkyl and mixtures thereof, $R^{13}$s are the same or different and are independently selected from $C_1$to $C_{24}$alkyl and mixtures thereof provided the average of the $R^{13}$groups is in the range of $C_4$to $C_8$, $R^{14}$is selected from $C_1$to $C_{12}$ alkyl and mixtures thereof, n'+m' are sufficient to provide the polymer having a weight average molecular weight of about 15,000 to about 80,000;

F)

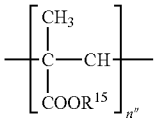

wherein n" is sufficient to provide the polymer having a weight average molecular weight of from about 20,000 to about 75,000 and $R^{15}$is $C_6$to $C_{30}$;

G) a poly[methacrylate] ester;

H) dodecyl methacrylate of about 40,000 to 60,000 weight average molecular weight.

6. The method of claim 5 wherein polymer II is added to the GTL base stock(s) and/or base oil(s) in an amount ranging from about 50 to 2500 ppm and the second polymer is added to the GTL base stock(s) and/or base oil(s) in an amount ranging from about 50 to 2500 ppm based on active ingredient.

7. The method of claim 6 wherein polymer II is added to the GTL base stock(s) and/or base oil(s) in an amount ranging from about 200 to 1000 ppm and the second polymer is added to the GTL base stock(s) and/or base oil(s) in an amount ranging from about 200 to 1000 ppm based on active ingredient.

8. The method of claim 5 wherein the second polymer is selected from the group consisting of polymer (A), (B), (E), (F), (H).

9. The method of claim 5 wherein the second polymer is selected from the group consisting of polymer (A), (B), (F), (H).

10. The method of claim 5 wherein the GTL base stock(s) and/or base oil(s) have a KV @100° C. of about 10 $mm^2/s$ or higher and the haze observed on standing at ambient temperature is reduced to a level evidenced by an NTU value of about 1.5 NTU or less at 20° C.±1° C. for at least 30 days.

11. A method for reducing the haze observed on standing at ambient temperature in Gas-to-Liquids (GTL) base stock(s) and/or base oil(s) having a kinematic viscosity @100° C. of about 8 $mm^2/s$ or higher to a level evidenced by an NTU value of about 2.0 NTU or less at 20° C.±1° C. for at least 13 days by the addition to the GTL base stock(s) and/or base oil(s) of an additive selected from the group consisting of a 4:1 to 1:4 mixture of a polymer of formula III III (polymer III) which is a mixture of (a)

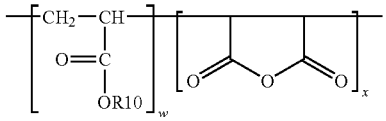

wherein $R^{10}$is $C_{12}$to $C_{14}$alkyl and mixtures thereof and w+x together are sufficient to produce the copolymer having a weight average molecular weight of about 800 to about 1000, and (b)

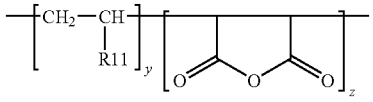

wherein $R^{11}$is $C_{12}$to $C_{14}$alkyl and mixtures thereof and y+z together are sufficient to produce the copolymer having a weight average molecular weight of about 7,000 to about 8,000, and (a) and (b) are in a ratio of about 60:40, and a second polymer selected from the group consisting of:

(c) a dodecyl methacrylate of about 40,000 to 60,000 average molecular weight.

12. The method of claim 8 wherein polymer III is added to the GTL base stock(s) and/or base oil(s) in an amount ranging from about 50 to 2500 ppm and the second polymer is added to the GTL base stock(s) and/or base oil(s) in an amount ranging from about 50 to 2500 ppm based on active ingredient.

13. The method of claim 9 wherein polymer III is added to the GTL base stock(s) and/or base oil(s) in an amount ranging from about 200 to 1000 ppm and the second polymer is added to the GTL base stock(s) and/or base oil(s) in an amount ranging from about 200 to 1000 ppm based on active ingredient.

14. The method of claim 11 wherein the GTL base stock(s) and/or base oil(s) have a KV @100° C. of about 10 $mm^2/s$ or higher and the haze observed on standing at ambient temperature is reduced to a level evidencing an NTU value of about 1.5 NTU or less at 20° C.±1° C. for at least 30 days.

* * * * *